US011371307B1

(12) United States Patent
Pruitt et al.

(10) Patent No.: US 11,371,307 B1
(45) Date of Patent: Jun. 28, 2022

(54) MODULAR BOWL WITH SWIVEL CONFIGURATION

(71) Applicant: PRUITT TOOL & SUPPLY CO., Fort Smith, AR (US)

(72) Inventors: Grant Pruitt, Fort Smith, AR (US); Cris Braun, Van Buren, AR (US); Andrew Lloyd Plowman, Charleston, AR (US)

(73) Assignee: PRUITT TOOL & SUPPLY CO., Fort Smith, AR (US)

( * ) Notice: Subject to any disclaimer, the term of this patent is extended or adjusted under 35 U.S.C. 154(b) by 0 days.

(21) Appl. No.: 17/107,406

(22) Filed: Nov. 30, 2020

Related U.S. Application Data

(63) Continuation of application No. 16/162,057, filed on Oct. 16, 2018, now Pat. No. 10,851,608, which is a continuation-in-part of application No. 15/464,021, filed on Mar. 20, 2017, now Pat. No. 10,287,845.

(51) Int. Cl.
*E21B 33/04* (2006.01)
*E21B 3/04* (2006.01)
*E21B 33/035* (2006.01)

(52) U.S. Cl.
CPC ..... *E21B 33/0415* (2013.01); *E21B 3/04* (2013.01); *E21B 33/0355* (2013.01)

(58) Field of Classification Search
CPC ..... E21B 3/03; E21B 33/085; E21B 33/0415; E21B 33/04
See application file for complete search history.

(56) References Cited

U.S. PATENT DOCUMENTS

2005/0236158 A1* 10/2005 Miyahara ..... E21B 33/085 166/379
2009/0120648 A1* 5/2009 Khazanovich ..... E21B 33/04 166/379

* cited by examiner

*Primary Examiner* — Kristyn A Hall
(74) *Attorney, Agent, or Firm* — Schrantz Law Firm, PLLC; Stephen D. Schrantz

(57) ABSTRACT

The modular bowl system provides a detachable bowl top and a modular bottom. The bowl top detaches to allow for easy repair of the bowl system should the bowl top become damaged. The detachable modular bottom securing to the bowl body for attaching the bowl body to the annular. The modular bottom provides a fixed attachment or a rotatable attachment of the bowl body with the annular. The modular bottom provides different sized bottom flanges for attachment to different sized annulars. The bowl body rotates for positioning of the bowl and the outlets and the inlet of the bowl for attachment to the flow line.

7 Claims, 19 Drawing Sheets

MODULAR BOWL WITH SWIVEL CONFIGURATION

CROSS-REFERENCE TO RELATED APPLICATIONS

This application claims priority to and is a continuation of U.S. patent application Ser. No. 16/162,057 filed on Oct. 16, 2018 entitled MODULAR BOWL WITH SWIVEL CONFIGURATION which is a continuation in part of U.S. patent application Ser. No. 15/464,021 filed on Mar. 20, 2017 entitled SWIVEL DEVICE FOR ROTATING A BOWL that issued as U.S. Pat. No. 10,287,845 on May 14, 2019 which are hereby incorporated by reference.

RESERVATION OF RIGHTS

A portion of the disclosure of this patent document contains material which is subject to intellectual property rights such as but not limited to copyright, trademark, and/or trade dress protection. The owner has no objection to the facsimile reproduction by anyone of the patent document or the patent disclosure as it appears in the Patent and Trademark Office patent files or records but otherwise reserves all rights whatsoever.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Field of the Invention

The present invention provides a modular bowl for securing to an annular. The modular bowl accepts an inner barrel and outer barrel of a rotating control device (RCD). The modular bowl provides a detachable top that can allow for quick repair of the bowl should the top be damaged.

The modular bowl also provides a bowl body that provides multiple flow apertures for different configurations of outlets and inlet. In one embodiment, the bowl body provides three outlets and one inlet. The outlets may include outlets of various sizes. Such sizes include, but are not limited to, 4 1/16"-2/3/5 M, 6"-3/5 M, 7 1/16"-3/5 M, and 9"-3 M. The various inlets include but are not limited to 2-1/16"-3/5 M and 4 1/16"-3/5 M.

The present invention also provides a modular bottom that secures to different sized annulars. Such a modular bottom enables use of the bowl body in different systems while reducing the amount of equipment needed at a drilling location. The modular bottom provides different sized bottom flanges for attaching to different sized annulars. Such bottoms enable attachment to such annulars requiring bottoms including but not limited to 7-5 M, 9-3 M, 9-5 M, 11-3 M, 11-5 M, 11-10 M, 13-5/8-3 M, 13-5/8-5 M, and 13-5/8-10 M.

The present invention also provides an adjustable bowl that pivots. Pivoting the bowl enables adjustment of the inlets and the outlets with the flowline. Adjusting the bowl positions the outlets and the inlets in proper position at the drilling site.

The present invention relates to securing drilling equipment while allowing for rotation and swiveling of the equipment for proper installation at the rig. The present invention also relates to a swivel device that attaches to the bowl or is a component of the bowl that allows repositioning of the outlet to meet the flowline.

Oil, gas, water and geothermal wells are typically drilled with a drill bit connected to a hollow drill string which is inserted into a well casing cemented in the well bore. A drilling head is attached to the well casing, wellhead or to an associated blowout preventer to seal the interior of the well bore from the surface. The drilling head also facilitates forced circulation of drilling fluid through the well while drilling or diverting drilling fluids away from the well. Drilling fluids include, but are not limited to, water, steam, drilling muds, air, and other gases.

In well drilling, with a rotary drilling rig, the drill bit and drilling pipe receive rotary motion from power equipment located on the surface. Below the drilling floor, at the ground surface, an assembly known as a rotating head allows the circulation of various fluids used in the drilling.

The rotating head is often located within a housing, such as a bowl. The housing remains stationary during rotation of the rotating head. The housing provides a flange with at least one flow aperture from which fluids can flow from the bowl. The flow aperture enables fluids and other material into the housing and downhole. The flow aperture also enables fluids and other material to flow from downhole and out of the housing through the flow line. Allowing the fluids to flow from the bowl enables the system to maintain the pressure for underbalanced drilling. A flow line attaches to the flange to allow the fluids to flow from the bowl.

Different sized flow lines may be required based upon the drilling operation. However, the flange of the bowl is configured to operate with a specific size of flow line. Therefore, the bowls are specifically designed for one sized flow line to be attached to the bowl. If a different flow line is needed during a drilling operation, the drilling operators must install a different bowl sized for the necessary flow line. Multiple bowls will be required to be stored for usage at a drilling operation. If the appropriate bowl is not available, the drilling operation may be halted until the bowl is available.

Present day drilling operations are extremely expensive. An effort to increase the overall efficiency of the drilling operation while minimizing expense requires essentially continuous operation of the drilling rig. Thus, it is imperative that downtime be minimized and costs be reduced.

The present invention relates to an adjustable bowl that swivels for alignment of the inlet and outlets with the flowline. The present invention also provides multiple outlets for different configurations and different sized flowlines. The bowl enables the attachment of different sized flow lines to the bowl. Enabling attachment of different sized flow lines to the bowl increases the usability of the bowl and reduces the equipment needed at a drilling site. Such a bowl also decreases manufacturing costs as a universal bowl can be used at the drilling site. Because the bowl of the present invention can be configured with multiple sized flow lines, the present invention also reduces downtime while waiting for a bowl of the required sized. The present invention also reduces down time as the bowl can be adjusted to position a different sized outlet instead of replacing the bowl if a different size is required.

The present invention also provides a bowl body with multiple outlets. The additional outlets allow for the use of the bowl body in a managed pressure drilling system in which multiple flow lines may be used in the system.

II. Description of the Known Art

Patents and patent applications disclosing relevant information are disclosed below. These patents and patent applications are hereby expressly incorporated by reference in their entirety.

U.S. Pat. No. 4,511,193 (the '193 patent) issued to Geczy on Apr. 16, 1985 teaches a combined radial and thrust bearing assembly for a down-hole drilling assembly to journal a shaft, mounting the drill bit, in a housing. The bearing assembly is used between a down-hole fluid powered motor and a drill bit for drilling oil wells, for example. The bearing assembly includes cooperative pairs of upper and lower inner races located on the shaft for mutual rotation. Each of the inner races includes a pair of interchangeable toroidal tracks. Cooperative pairs of upper and lower outer races are fixed against rotation in the housing. Each outer race has a pair of interchangeable toroidal tracks to selectively cooperate with the tracks of the inner races to define a toroidal channel to receive a number of bearing balls. Spring means are disposed between the upper and lower pairs of outer races and the housing and between the upper and lower pairs of outer races to provide a compliant coupling for the even distribution of radial and upwardly and downwardly directed thrust loads between the races and balls and eventual transfer to the housing. Drilling fluid is circulated through the bearing assembly for cooling and lubrication.

U.S. Pat. No. 5,213,158 ("the '158 patent") issued to Bailey, et al. on May 25, 1993 teaches a drilling head with dual rotating stripper rubbers designed for high pressure drilling operations ensuring sealing under the extreme conditions of high flow or high pressure wells such as horizontal drilling. The dual stripper rubbers taught by the '158 patent seal on the same diameter yet are manufactured of different materials for different sealing functions. The lower stripper rubber is manufactured from a more rigid, abrasive resistant material to divert the flow from the well. The upper stripper rubber is manufactured of a softer sealing material that will closely conform to the outer diameter of the drill string thereby preventing the flow of fluids through the drilling head.

U.S. Pat. No. 5,647,444 issued to Williams on Jul. 15, 1997 ("the '444 patent") discloses a rotating blowout preventor having at least two rotating stripper rubber seals which provide a continuous seal about a drilling string having drilling string components of varying diameter. A stationary bowl taught by the '444 patent is designed to support a blowout preventor bearing assembly and receives a swivel ball that cooperates with the bowl to self-align the blowout preventor bearing assembly and the swivel ball with respect to the fixed bowl. Chilled water taught by the '444 patent is circulated through the seal boxes of the blowout preventor bearing assembly and liquid such as water is pumped into the bearing assembly annulus between the stripper rubbers to offset well pressure on the stripper rubbers.

U.S. Pat. No. 3,868,832 issued to Biffle on Mar. 4, 1975 ("the '832 patent") teaches a rotary drilling head assembly for wellbore forming operations comprising a stationary housing which supports a rotatable sleeve. A stripper rubber located within the rotatable sleeve taught by the '832 patent slidably receives a tubing string in sealed relationship therethrough.

SUMMARY OF THE INVENTION

The modular bowl system of the present invention provides a modular system that enables a detachable bowl top and a modular bottom. The bowl top detaches to allow for easy repair of the bowl system should the top become damaged.

The present invention also provides a modular bottom for securing to the bowl body. The modular bottom attaches to the bowl body and the annular. In one embodiment, the modular bottom provides a fixed attachment of the bowl body to the annular. In another embodiment, the modular bottom provides a rotatable connection of the bowl body with the annular.

The modular bottom provides different sized bottom flanges for attachment to different sized annulars. Such bottoms enable attachment to such annulars requiring bottoms including but not limited to 7-5 M, 9-3 M, 9-5 M, 11-3 M, 11-5 M, 11-10 M, 13-5/8-3 M, 13-5/8-5 M, and 13-5/8-10 M.

The present invention of one embodiment provides a swivel neck that rotates for positioning of the bowl and the outlets and the inlet of the bowl. The bowl attaches to a flow line to allow fluids to flow into and/or out of the housing. A flow aperture of the bowl provides access into the interior of the housing from the side of the housing. The flow aperture may serve as an outlet. In one embodiment, the bowl provides multiple flow apertures, including but not limited to three outlets and an inlet. The flow aperture enables fluids and other materials to flow from downhole into the housing and through the flow line. The flow line attaches at the flange of the housing. The flanges of the known art allow only one given size of flow line to attach at the flange.

The bowl with multiple flow apertures of the present invention enables attachment of flow lines of multiple sizes to the bowl. In one embodiment, the bowl provides four flow apertures, three outlets and an inlet. The outlets can be sized according to the needs at the well. The outlets may include outlets of various sizes. Such sizes include, but are not limited to, 4 1/16"-2/3/5 M, 6"-3/5 M, 7 1/16"-3/5 M, and 9"-3 M. The inlets include but are not limited to 2-1/16"-3/5 M and 4 1/16"-3/5 M.

The bowl with multiple flow apertures attaches to a swivel neck that enables rotation of the bowl body in relation to the annular and the base. Such rotation of the bowl body positions the inlet and the outlets of the bowl body in proper orientation with the flow line.

The known art provides a bowl with a flange that secures only a single size flow line. The known art does not allow the attachment of different sized flow lines to the bowl. To attach flow lines of different diameters, the drilling operation requires installing a separate bowl for attachment of different sized flow line. If the drilling team requires a flow line of a different diameter, drilling must cease while the drilling team installs the appropriate bowl. If the appropriate sized bowl is not available, drilling operations may cease until the appropriate equipment is available. The present invention provides a bowl body that attaches to flow lines of multiple diameters.

It is an object of the present invention to provide a modular bowl system.

It is an object of the present invention to provide a bowl body that enables attachment of a bowl top for replacing a damaged top of the bowl.

It is another object of the preset invention to provide a modular bottom that secures the bowl body to the annular.

It is another object of the present invention to provide a bowl body capable of attaching to different sized modular bottoms for securing to different sized annulars.

It is another object of the present invention to provide multiple flow apertures for the bowl system.

It is another object of the present invention to increase the functionality of the bowl.

It is an object of the present invention to swivel the outlet of the bowl to align with the flowline.

Another object of the present invention is to reduce the time required to install the bowl.

Another object of the present invention is to reduce the time required to connect the flowline to the outlet of the bowl.

Another object of the present invention is to allow for the trouble-free connection of the flowline to the outlet of the bowl.

Another object of the present invention is to create a safer work environment for rig personnel.

Another object of the present invention is to avoid unnecessary removal of the bowl to align the bowl with the flowline.

Another object of the present invention is to simplify the method of connecting the outlet to the flowline.

Another object of the present invention is to allow attachment of flow lines of multiple sizes to the bowl.

Another object of the present invention is to reduce downtime of a drilling operation.

Another object of the present invention is to simplify the method of attaching and removing a flow line to the bowl.

Another object of the present invention is to eliminate the need for different sized bowls.

It is another object of the present invention to reduce manufacturing costs of the bowl.

It is another object of the present invention to reduce transportation costs associated with transporting the bowls to the drilling site.

In addition to the features and advantages of the modular bowl system adapter according to the present invention, further advantages thereof will be apparent from the following description in conjunction with the appended drawings.

These and other objects of the invention will become more fully apparent as the description proceeds in the following specification and the attached drawings. These and other objects and advantages of the present invention, along with features of novelty appurtenant thereto, will appear or become apparent in the course of the following descriptive sections.

BRIEF DESCRIPTION OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION

Figure 1:
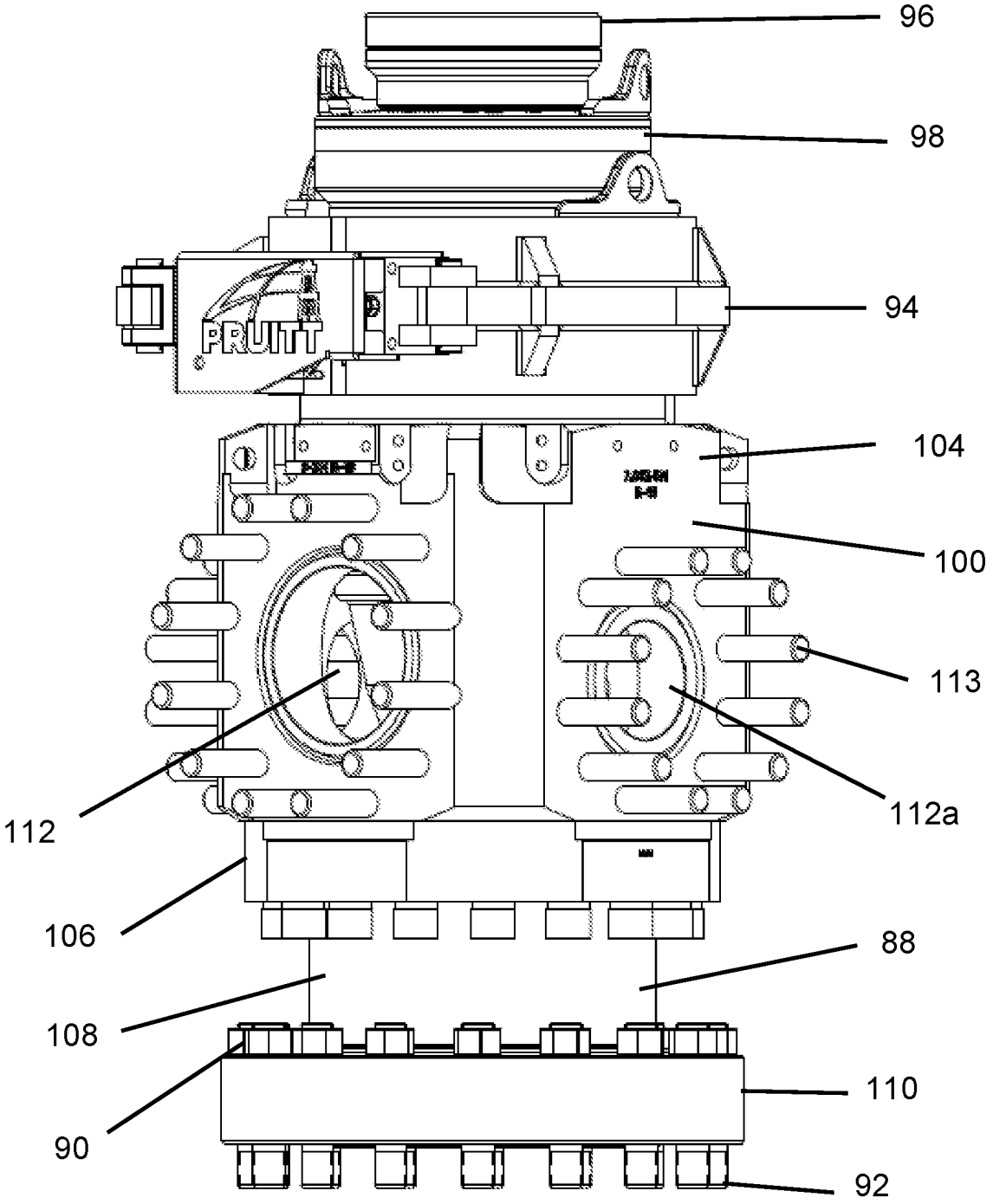
FIG. 1 is an environmental view showing one embodiment of the present invention.

FIG. 1 shows the modular bowl system 100 of the present invention. The inner barrel 96 and outer barrel 98 are secured within the bowl system 100. The bowl system 100 provides multiple flow apertures such as outlets 112, 112*a*. The multiple flow apertures may provide outlets of different sizes for attaching to differently sized flow lines. An outlet flange secures to the bowl system at studs 113 adjacent the selected outlet 112, 112*a* to be connected to the flowline.

FIG. 1 shows the bowl body 104 secured to the modular bottom 88. In one embodiment, the modular bottom 88 is a single fixed piece for a fixed connection of the bowl body to the annular. In another embodiment, the modular bottom 88 is constructed from multiple components to allow rotation of the bowl body 104 in relation to the annular. The modular bottom 88 of such an embodiment provides a swivel neck 108 that rotates within the base 110. The user rotates the bowl body 104 to align the properly sized outlet 112, 112*a* with the flow line. The user then tightens fasteners, such as nuts 90 on studs 92, to limit rotation of the bowl body 104 and the outlets 112, 112*a*. Tightening nuts 90 on studs 92 limits the movement of the bowl body 104 and the outlets 112, 112*a* as shown in FIG. 1.

To rotate the bowl body 104 within the base 110, the user loosens nuts 90 from studs 92. The bowl body 104, swivel neck 108, and connector 106 can then rotate.

The modular bottom 88 secures to the bowl body 104. The modular bottom 88 also secures to the flange to attach the bowl body 104 with the flange. The modular bottom 88 provides a lower flange that varies in size to allow for connections to different sized annulars. The lower flange includes, but is not limited to, attaching the bowl body to flanges sized for 7-5 M, 9-3 M, 9-5 M, 11-3 M, 11-5 M, 11-10 M, 13-5/8-3 M, 13-5/8-5 M, and 13-5/8-10 M.

Continuing to refer to FIG. 1, the bowl system 100 secures the rotating inner barrel 96 and the stationary outer barrel 98. Clamp 94 secures the outer barrel 98 with the bowl system 100.

The bowl system 100 secures to the annular at a drilling site. The annular provides attachment studs 92 that secure the base 110. Nuts 90 tighten down on studs 92 to secure the base 110 to the annular.

Referring to FIG. 1, the modular bowl system 100 of the present invention secures to the annular. A base 110 attaches to the annular. In the fixed version, the modular bottom 88 secures the bowl body 104 with the annular in a fixed position. The modular bottom 88 remains stationary with the annular.

In the rotating embodiment, the bowl body 104, bowl top 102, bowl connector 106, and swivel neck 108 swivel for alignment of the properly sized outlet 112 with the flow line. The swivel neck 108 pivots within the base 110. The base 110 remains fixed while the swivel neck 108 rotates the outlets 112 and the bowl body 104.

The user adjusts the bowl body 104 to align the outlet 112 with the flow line. The bowl body 104 provides at least two flow apertures, including four flow apertures in one embodiment. In one embodiment, the bowl body 104 provides either one, two, or three outlets and at least one inlet. The outlets may vary in size and configurations. Such sizes of the outlet include, but are not limited to, 4 1/16"-2/3/5 M, 6"-3/5 M, 7 1/16"-3/5 M, and 9"-3 M. Similarly, the inlet may vary in size. The various inlets include but are not limited to 2-1/16"-3/5 M and 4 1/16"-3/5 M.

Figure 2:
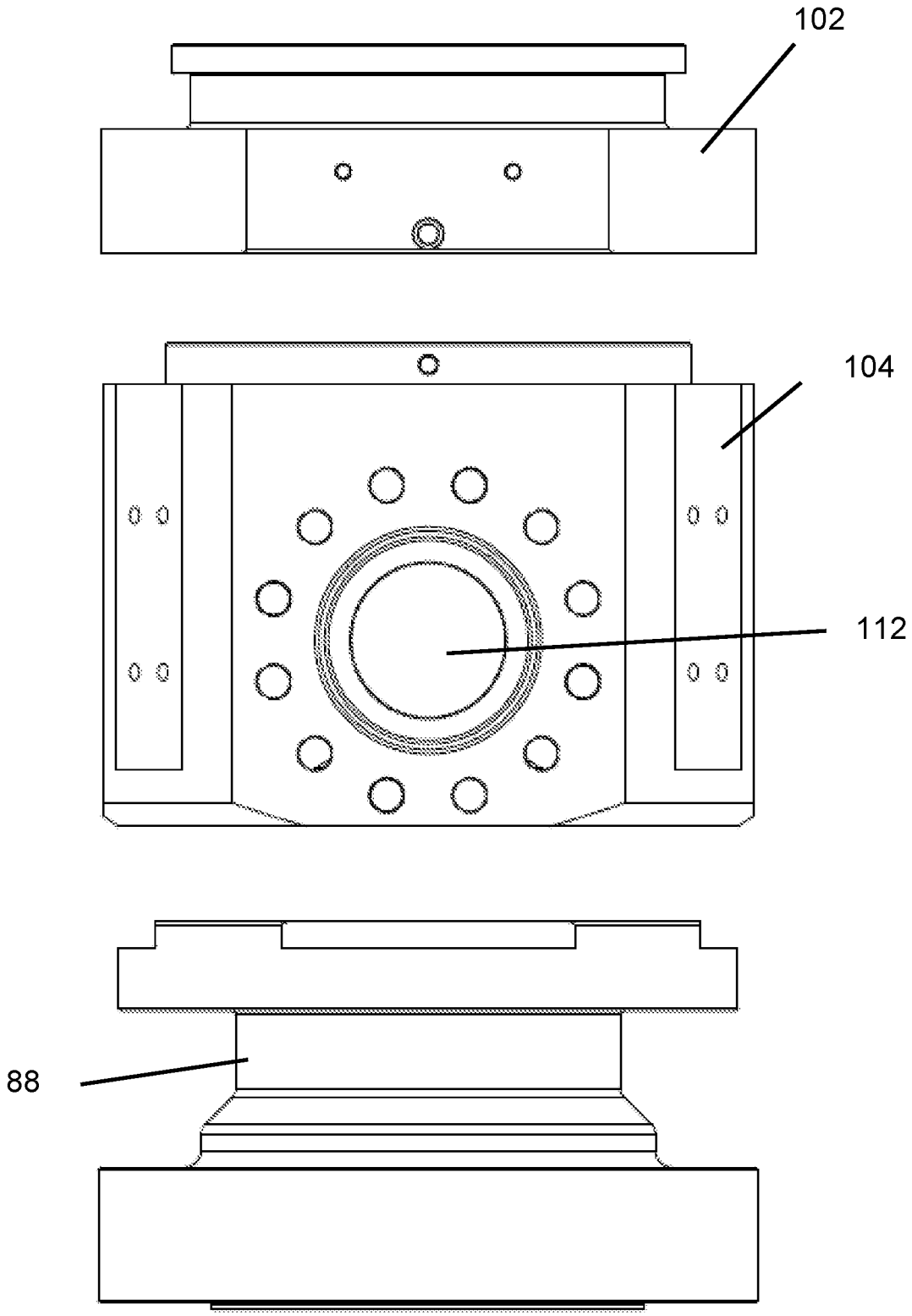
FIG. 2 is an exploded view of one embodiment of the present invention.

FIG. 2 shows an exploded view of the bowl system with a modular bottom 88 that secures the bowl body 104 in a fixed position with the annular. Bowl top 102 secures above the bowl body 104. An alignment aperture on an outer side surface of the bowl top 102 aligns with an alignment aperture on an outer side surface of the bowl body 104. Alignment of the alignment apertures indicates proper alignment of the bowl top 102 with the bowl body 104.

Fasteners attached through the fastener apertures of the bowl top 102 and the bowl body 104 secure the bowl top 102 with the bowl body 104. Fasteners secure the bowl body 104 to the modular bottom 88. The modular bottom 88 secures the bowl body 104 to the annular.

Figure 3:
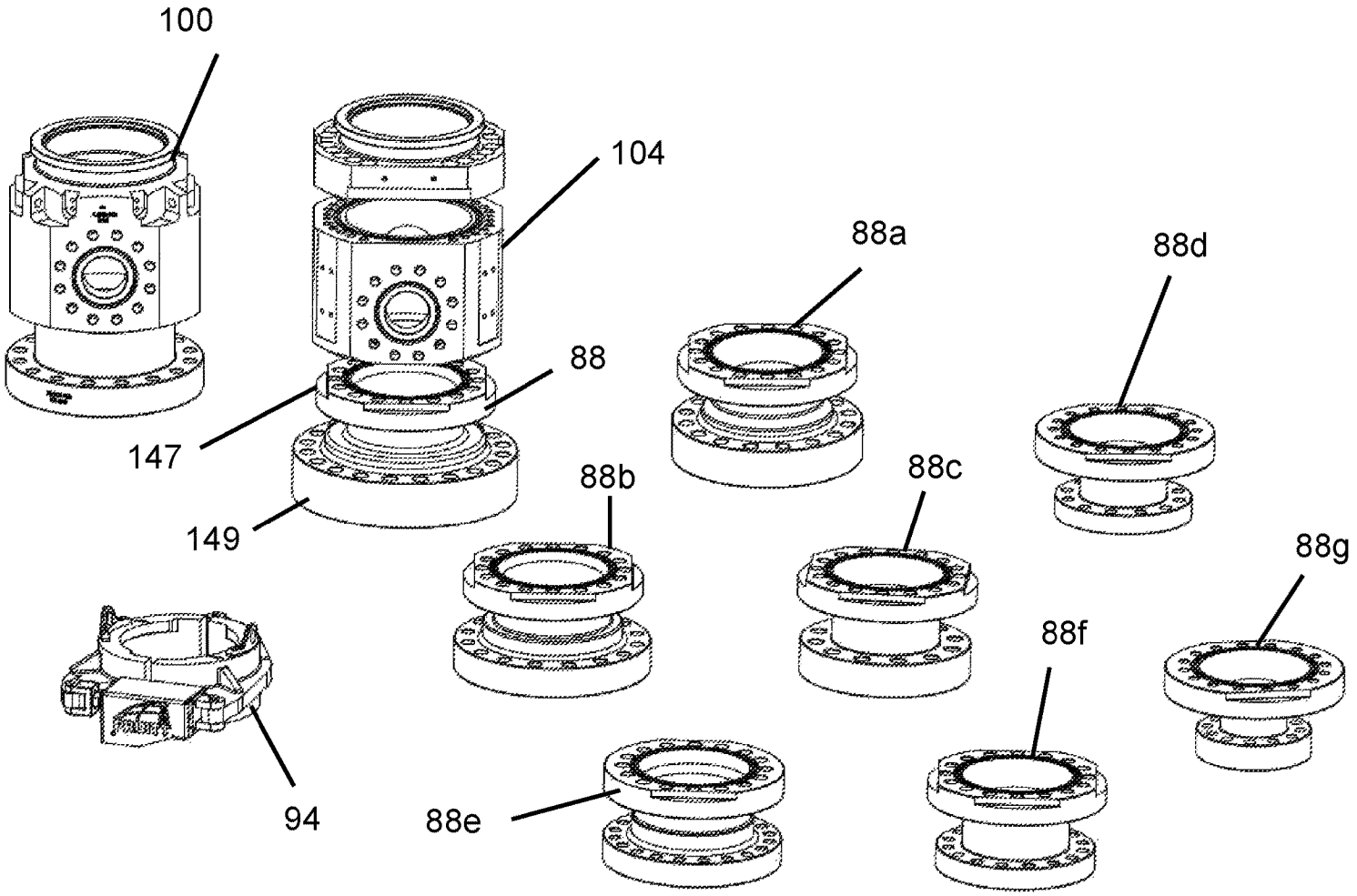
FIG. 3 is an exploded view of one embodiment of the present invention.

FIG. 3 shows the variations of the modular bottoms 88, 88*a*, 88*b*, 88*c*, 88*d*, 88*e*, 88*f*, 88*g*. The modular bottoms 88 provide an upper flange 147 that secures to the bowl body 104. The modular bottoms 88 also provide a lower flange 149 that secures the bowl body 104 to the annular. The modular bottoms 88 provide attachment aperture in the upper flange 147 and attachment apertures 149 in the lower flange 149.

The upper flange 147 secures to the bowl body 104. Modular bottoms 88, 88*a*, 88*b*, 88*c*, 88*d*, 88*e*, 88*f*, 88*g* provide an upper flange 147 that is sized for attachment to the bowl body 104. The size of the upper flange 147 remains consistent due to the fixed size of the bowl body 104.

The modular bottom 88 configures the bowl body 104 to attach to annulars of different sizes. The user secures the bowl body 104 to the bowl bottom 88 required to secure the bowl body 104 to the annular. The size of the lower flange 149 varies according to the annular to which the bowl body 104 attaches. The user simply attaches the proper modular bottom 88 to the bowl body 104. The user may then secure the bowl body 104 to the annular. The diameter of the lower flange and the spacing of the attachment apertures of the lower flange vary according to the size of the annular to which the bowl body 104 attaches.

Figure 4:
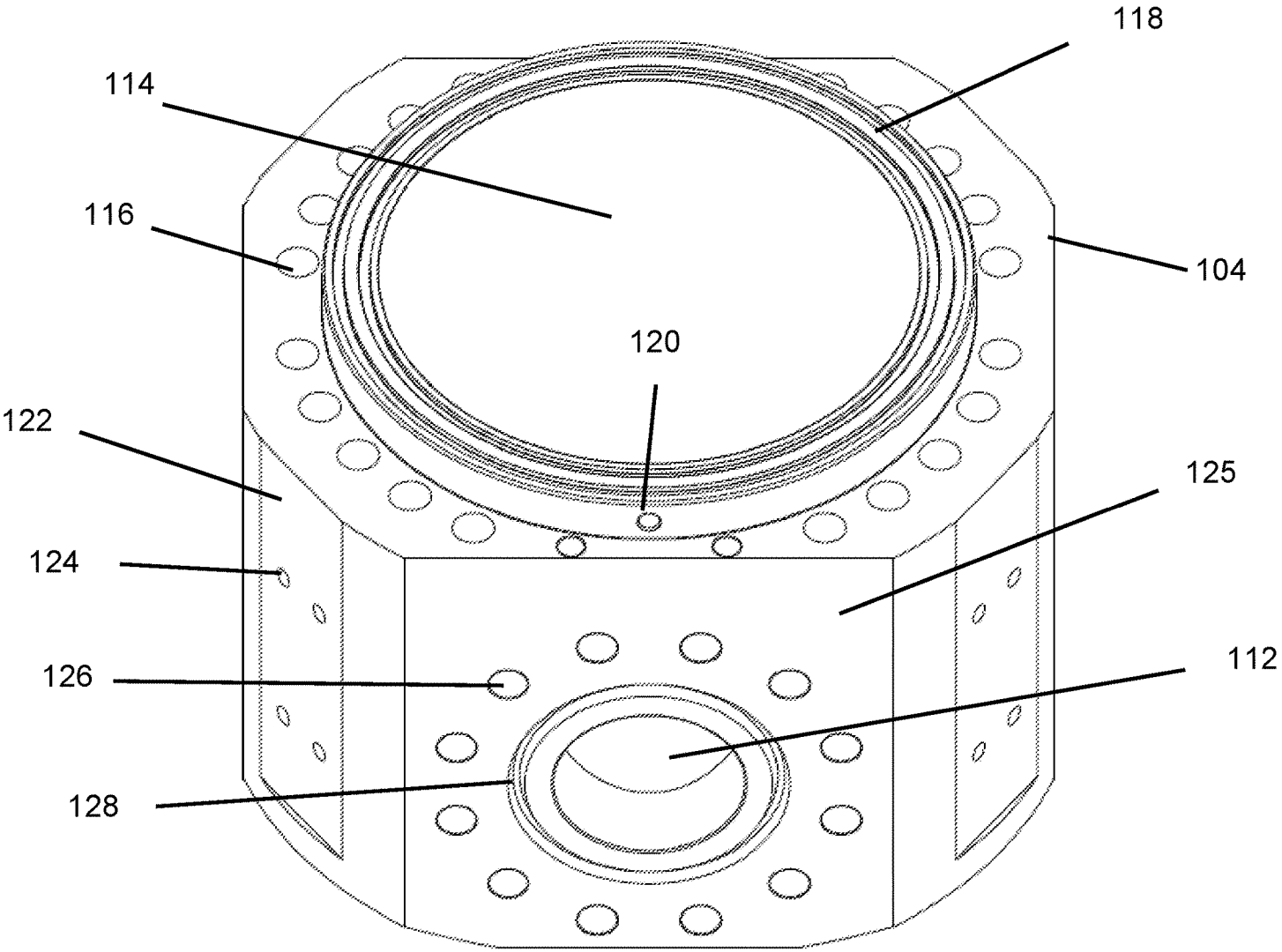
FIG. 4 is a top perspective view of a bowl body of one embodiment of the present invention.

FIG. 4 shows a perspective view of the bowl body 104. Alignment aperture 120 aligns with the alignment aperture of the bowl top to confirm proper alignment of the bowl top with the bowl body 104. The alignment of the alignment apertures orients the bowl top with the bowl body. Fasteners insert downward through the bowl top into the attachment apertures 116 of the bowl body. The attachment apertures 116 are located laterally outward from the bore 114. In one embodiment the attachment apertures 116 are located radially outward from the bore 114.

Seals located between the bowl top and the bowl body 104 seal the attachment between the bowl top and the bowl body 104. Top seal grooves 118 located at an upper surface of the bowl body 104. The top seal grooves 118 accept at least one seal for sealing between the bowl top and the bowl body 104.

A flow aperture facing 125 provides a flattened surface for securing the flowline. Fasteners secure a flange of the flowline to the flow aperture facing 125 at facing apertures 126. The fasteners secure the flow line to the bowl body 104 at the attachment apertures 126 located laterally outward from the flow aperture 112. In one embodiment, the attachment apertures 126 are located radially outward from the flow aperture 112.

Seal grooves 128 located adjacent the flow aperture 112 accept a seal. The seal at seal groove 128 seals the attachment between the flowline and the facing 125. As discussed above, the bowl body 104 provides multiple flow apertures. In one embodiment, the bowl body 104 provides at least one inlet and one outlet. In one embodiment, the bowl body 104 provides three outlets and an inlet. The bowl body provides facing apertures around each flow aperture similarly as shown in FIG. 4. The seal groove 128 is located around each flow aperture.

The bowl body 104 also provides tie down pads 122 for securing modular tie downs. Fasteners secure the modular tie downs at tie down attachment apertures 124.

Figure 5:
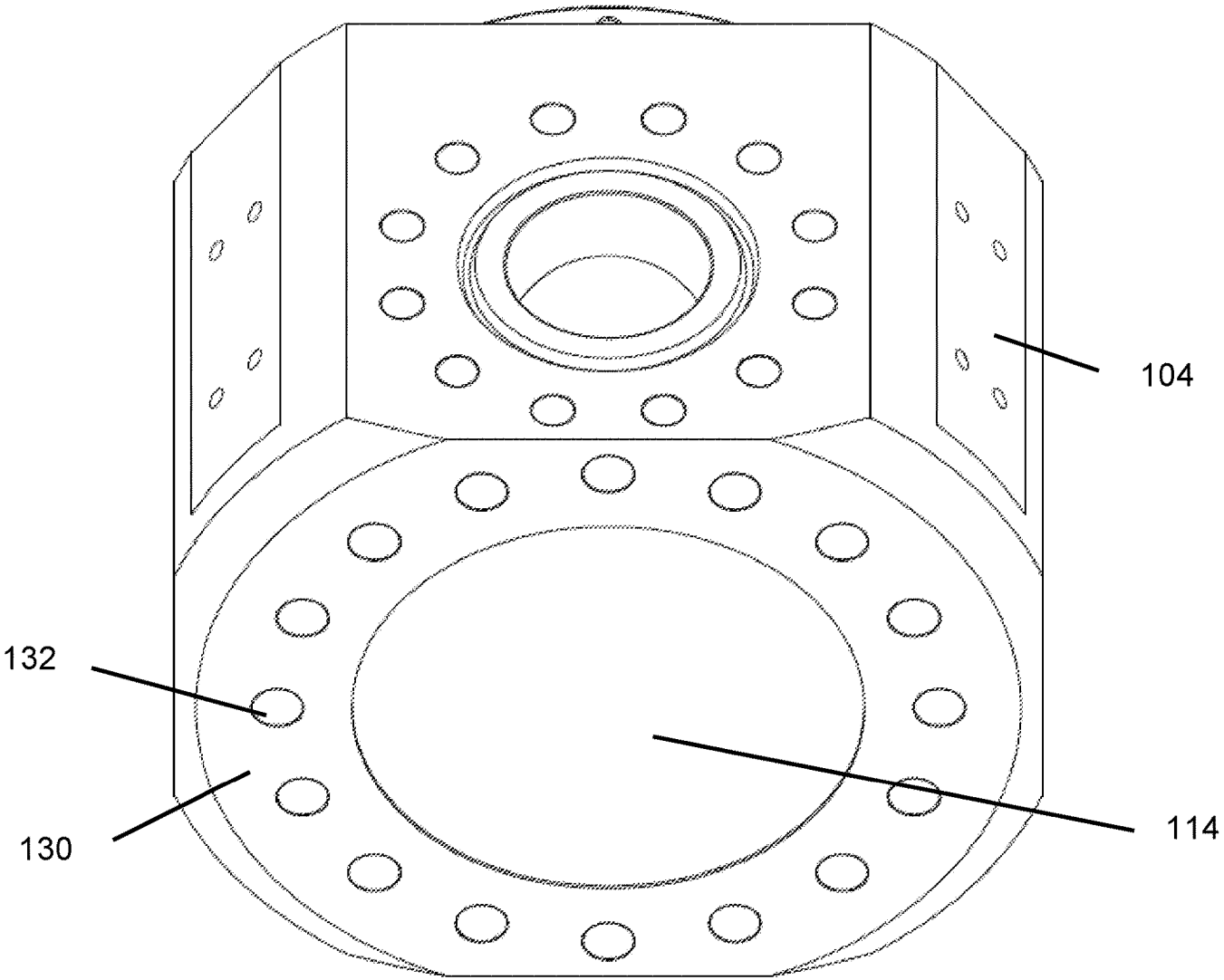
FIG. 5 is a bottom perspective view thereof.

FIG. 5 shows another perspective view of the bowl body 104. Bore 114 extends vertically down through the bowl body 104. A bottom surface 130 abuts the modular bottom when securing the bowl body 104 to the modular bottom. The bottom surface 130 provides lower attachment apertures 132 that accept fasteners for securing the bowl body 104 to the modular bottom. The lower attachment apertures 132 are located laterally outward from the bore 114. In one embodiment, the lower attachment apertures 132 are located radially outward from the bore 114.

Figure 6:
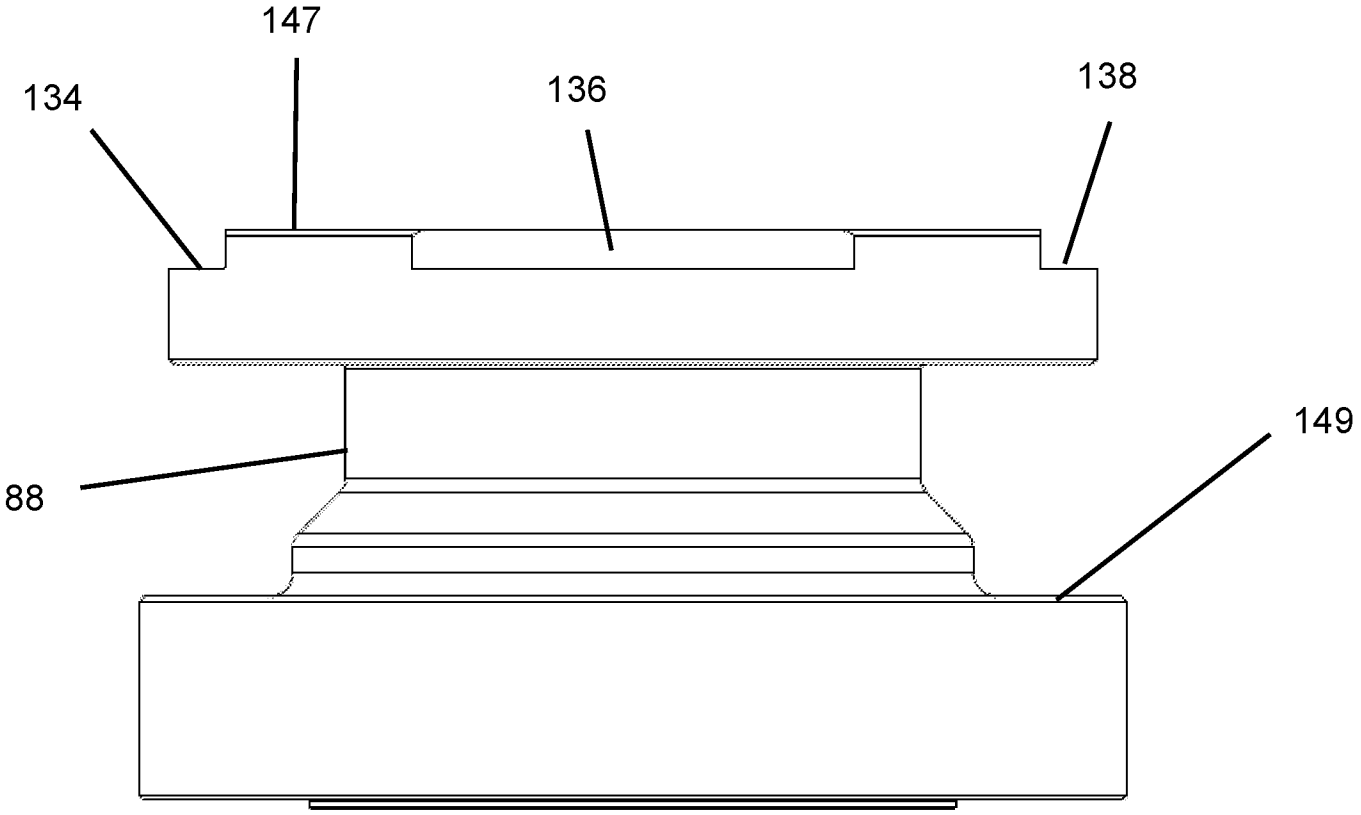
FIG. 6 is a front view of a modular bottom of one embodiment of the present invention.
Figure 7:
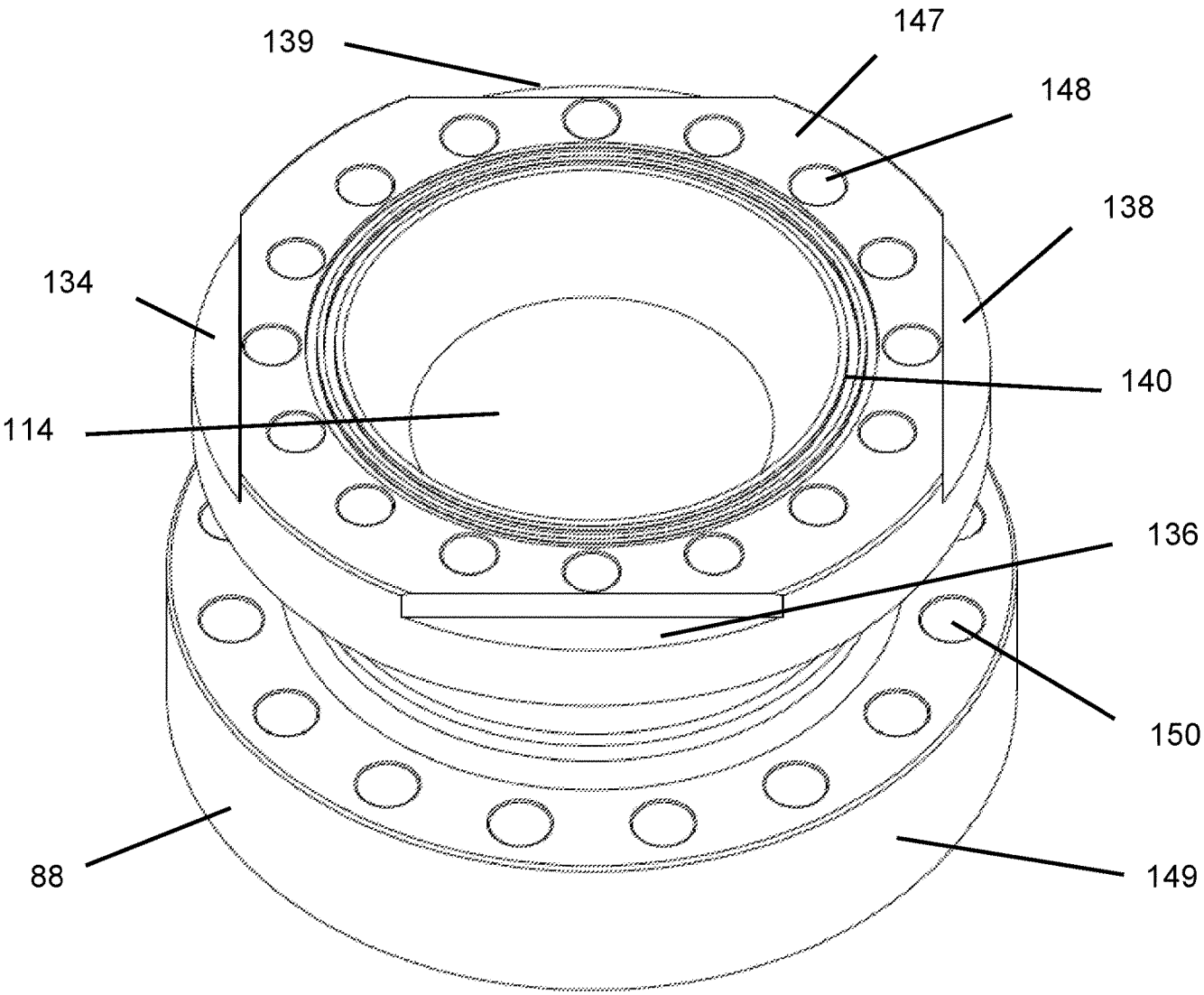
FIG. 7 is a top perspective view thereof.
Figure 8:
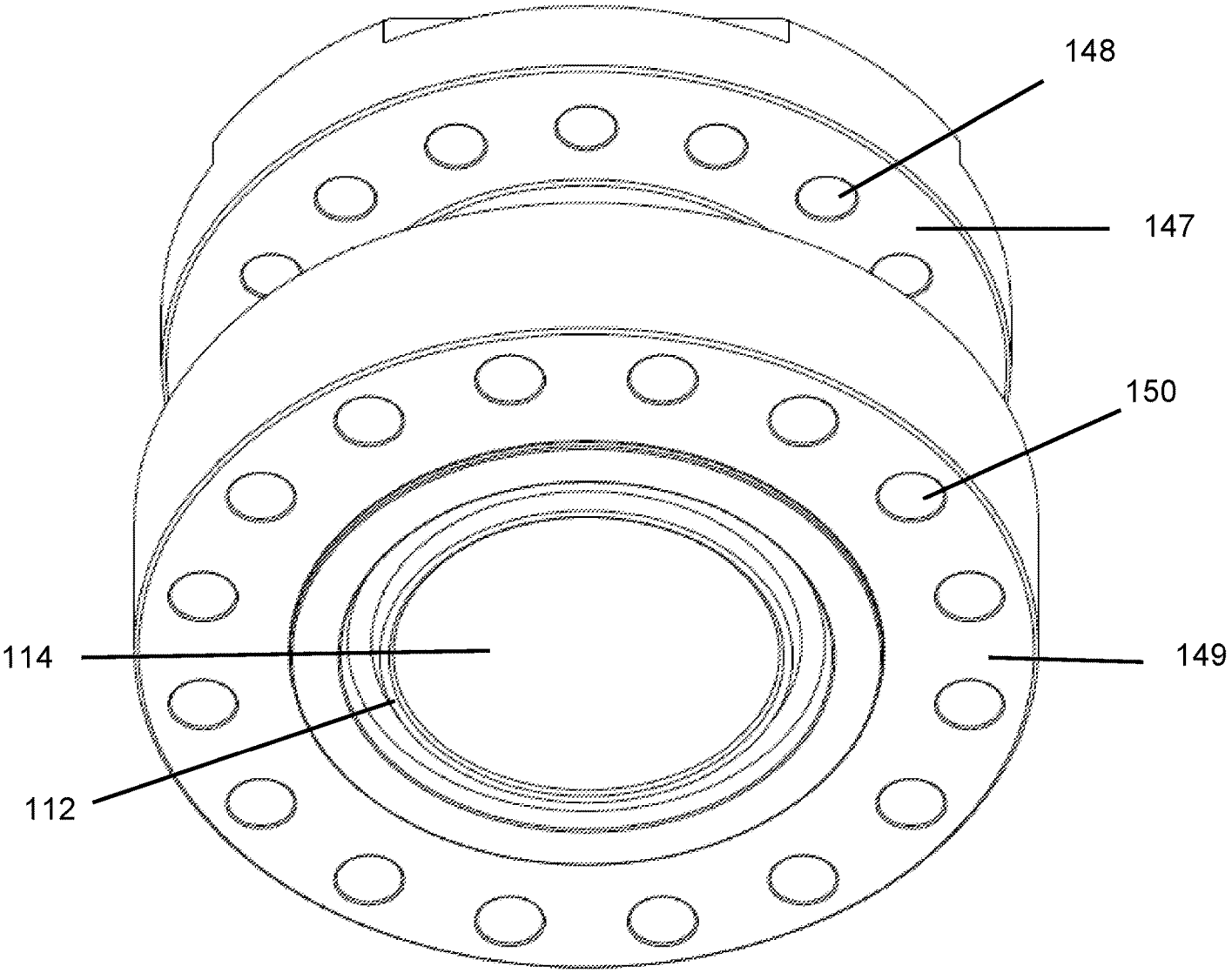
FIG. 8 is a bottom perspective view thereof.
Figure 9:
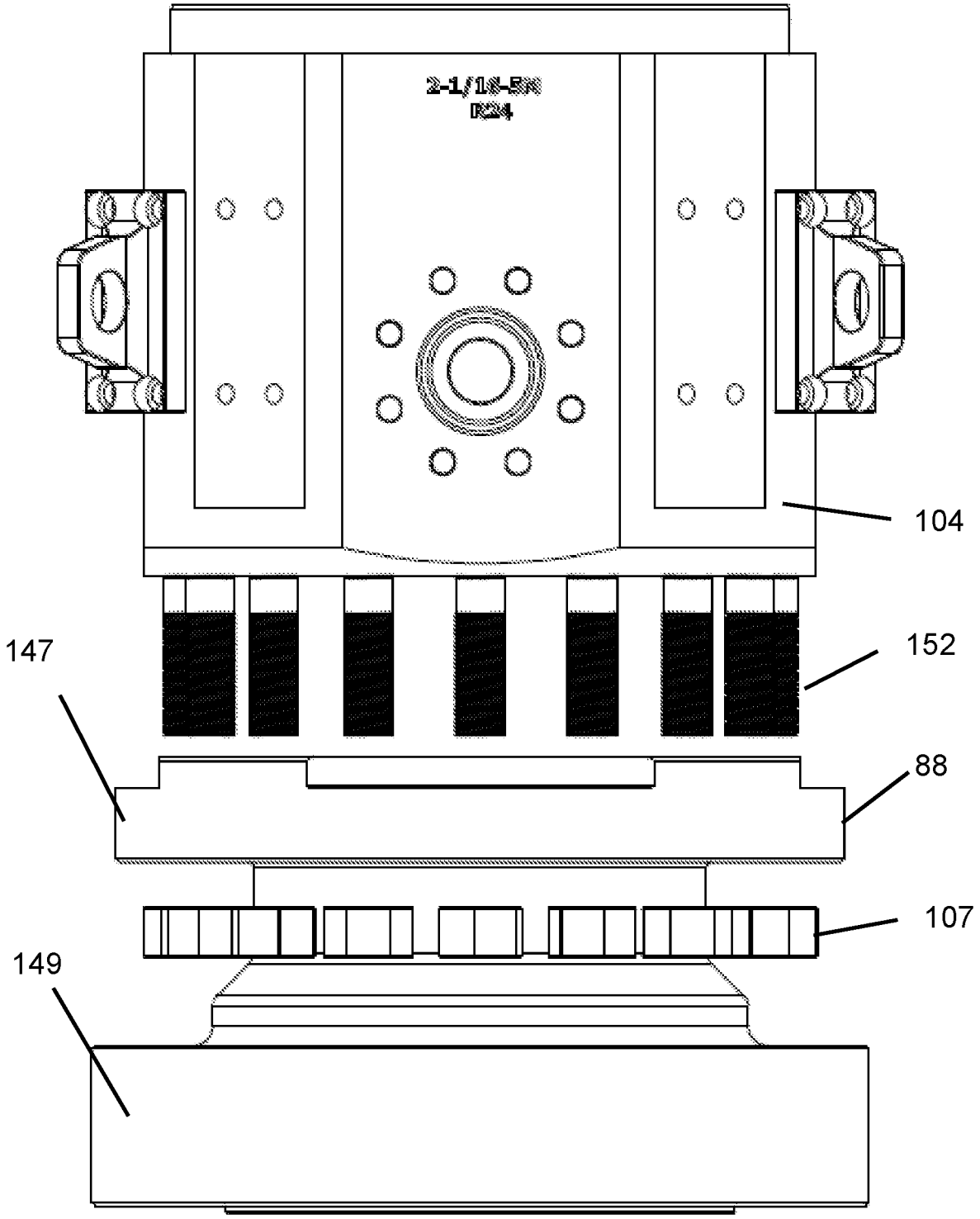
FIG. 9 is an exploded view thereof.

FIGS. 6-8 show the modular bottom 88 that secures to the annular and the bowl body. The modular bottom 88 provides clearance apertures 134, 136, 138 that align with the facings 125 at the flow apertures. The clearance apertures 134, 136, 138 provide sufficient clearance for securing the flow line to the bowl body 104 at the flow apertures.

FIG. 7 shows the four clearance apertures 134, 136, 138, 139. The four clearance apertures 134, 136, 138, 139 align with the facings of the bowl body 104 at which the flow apertures are located.

The modular bottom 88 provides attachment apertures 148 located laterally outward from the seal groove 140 and the bore 114. The attachment apertures 148 are located on the upper flange 147 of the modular bottom 88. The upper flange 147 abuts the bowl body when connecting the bowl body to the modular bottom 88. In one embodiment, the attachment apertures 148 are located radially outward from the seal groove 140 and the bore 114. The attachment apertures 148 accept fasteners for securing the modular bottom 88 to the bowl body.

Lower attachment apertures 150 of the lower flange 149 of the modular bottom 88 secure the modular bottom 88 to the annular. The lower flange 149 of the modular bottom 88 secures to the annular to attach the bowl body to the annular in a fixed position.

FIG. 8 shows the lower flange 149 with attachment apertures 150. The attachment apertures 150 pass through the lower flange 149. Attachment apertures 148 pass through the upper flange 147. The lower flange 149 provides attachment apertures 150 located laterally outward from the seal groove 112 and the bore 114. In one embodiment, the attachment apertures 150 are located radially outward from the seal groove 112 and the bore 114. The attachment apertures 150 accept fasteners for securing the modular bottom 88 to the annular.

In one embodiment as shown in FIGS. 7-10, fasteners, such as studs 152, inserted into attachment apertures 132 of the bowl body 104 extend downward through attachment apertures 148 of the upper flange 147 of modular bottom 88. Fasteners 107, such as the nuts, secure the upper flange 147 of the modular bottom 88 onto the bowl body 104.

Figure 10:
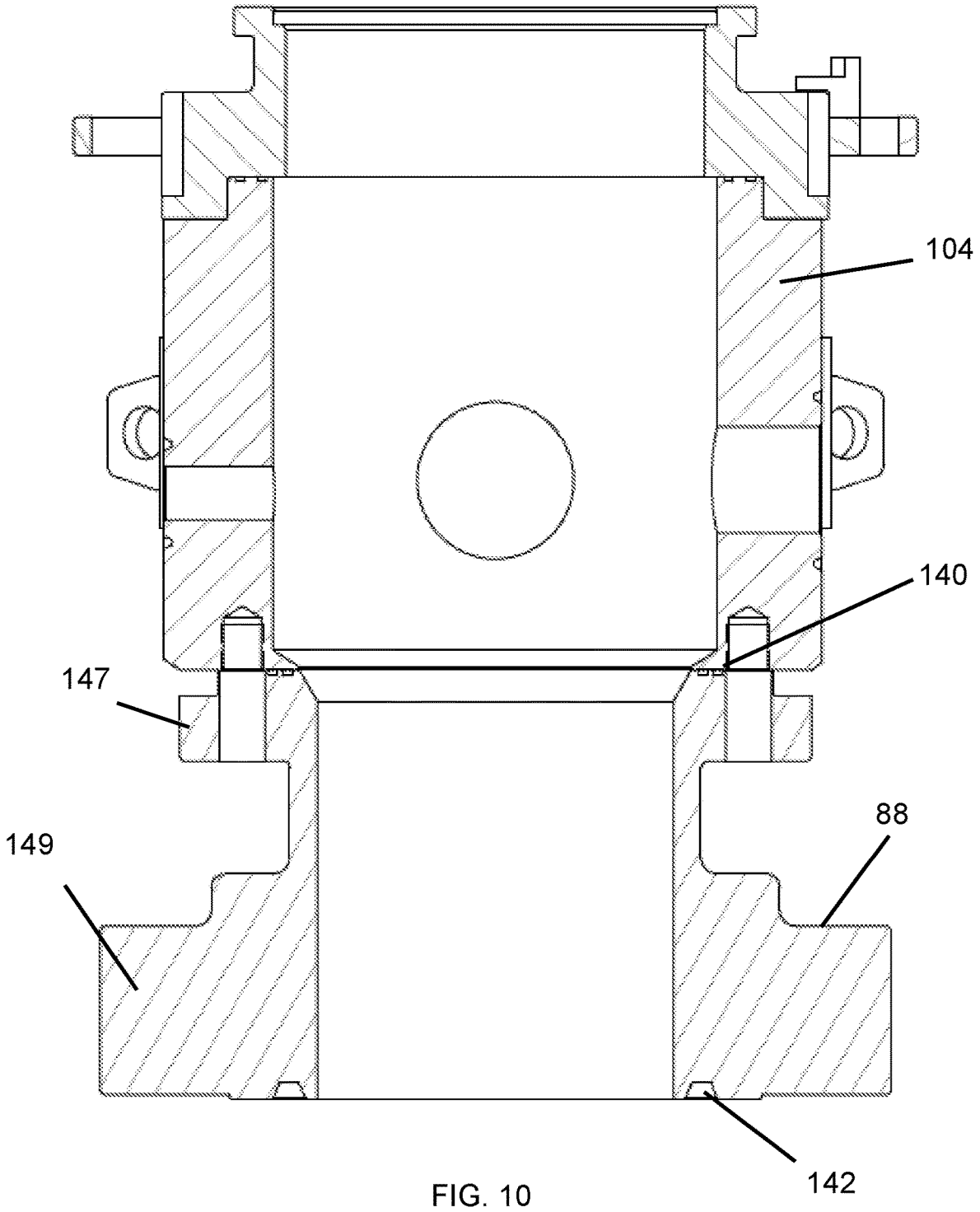
FIG. 10 is a top view thereof.
Figure 10A:
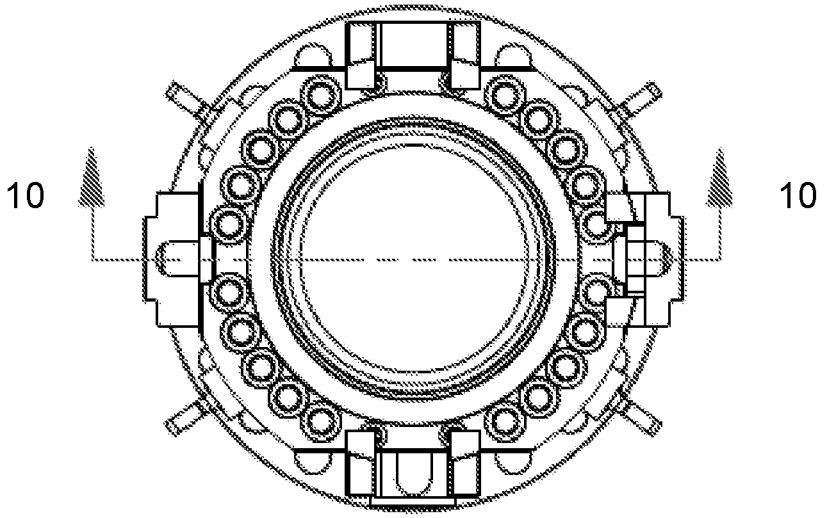
FIG. 10A is a sectional view thereof.

FIG. 10 shows the seal grooves 140 located between the bowl body 104 and the modular bottom 88. The seal grooves 140 accept at least one or two seals to seal the upper flange 147, the bowl body 104, and the modular bottom 88. Seal groove 142 accepts a seal to seal the lower flange 149 with the annular.

Figure 11:
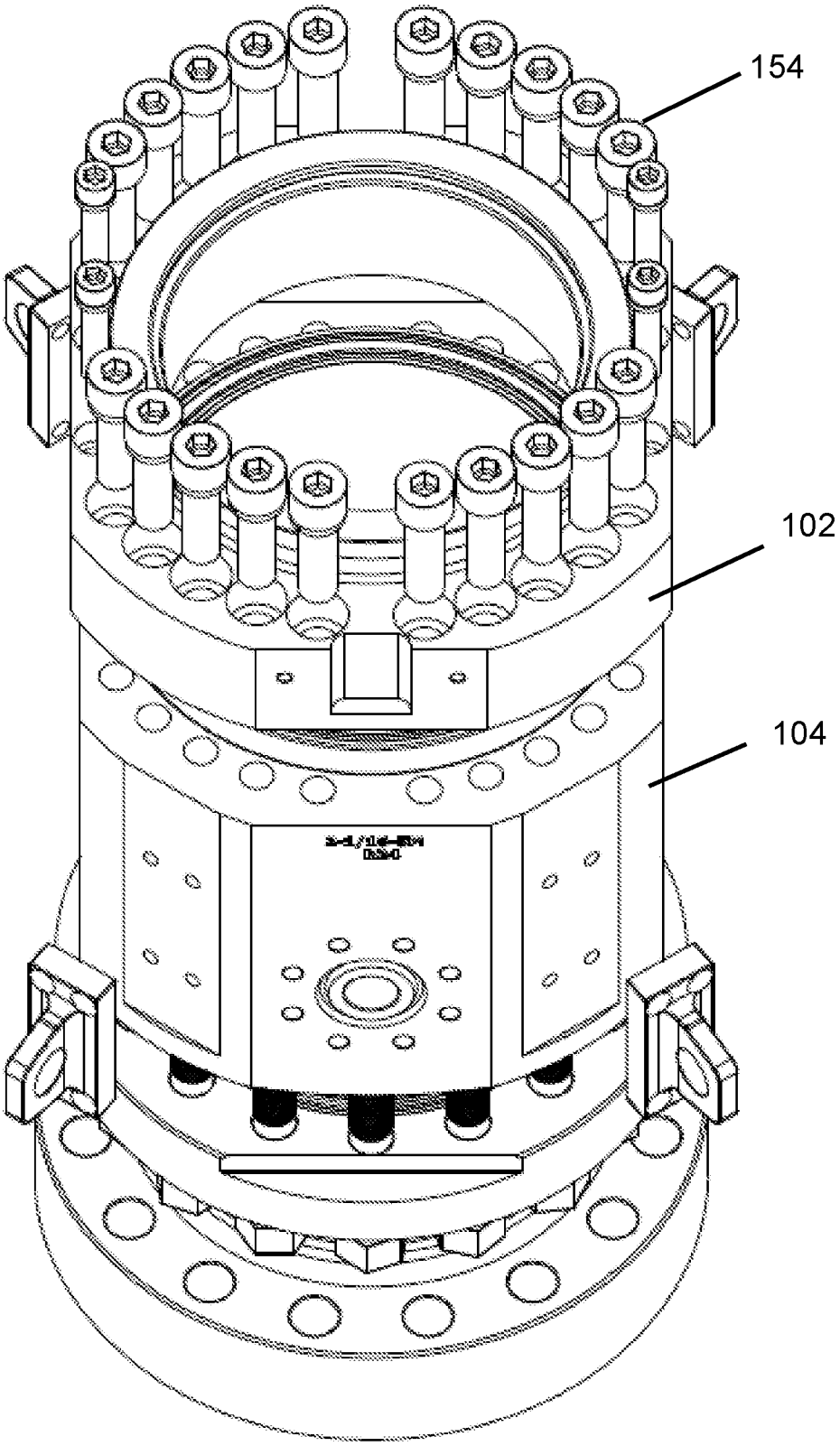
FIG. 11 is an exploded view of one embodiment of the present invention.

FIG. 11 shows the fasteners 154 that install downward into bowl top 102. The fasteners 154 secure the bowl top 102 to the bowl base 104.

Figure 12:
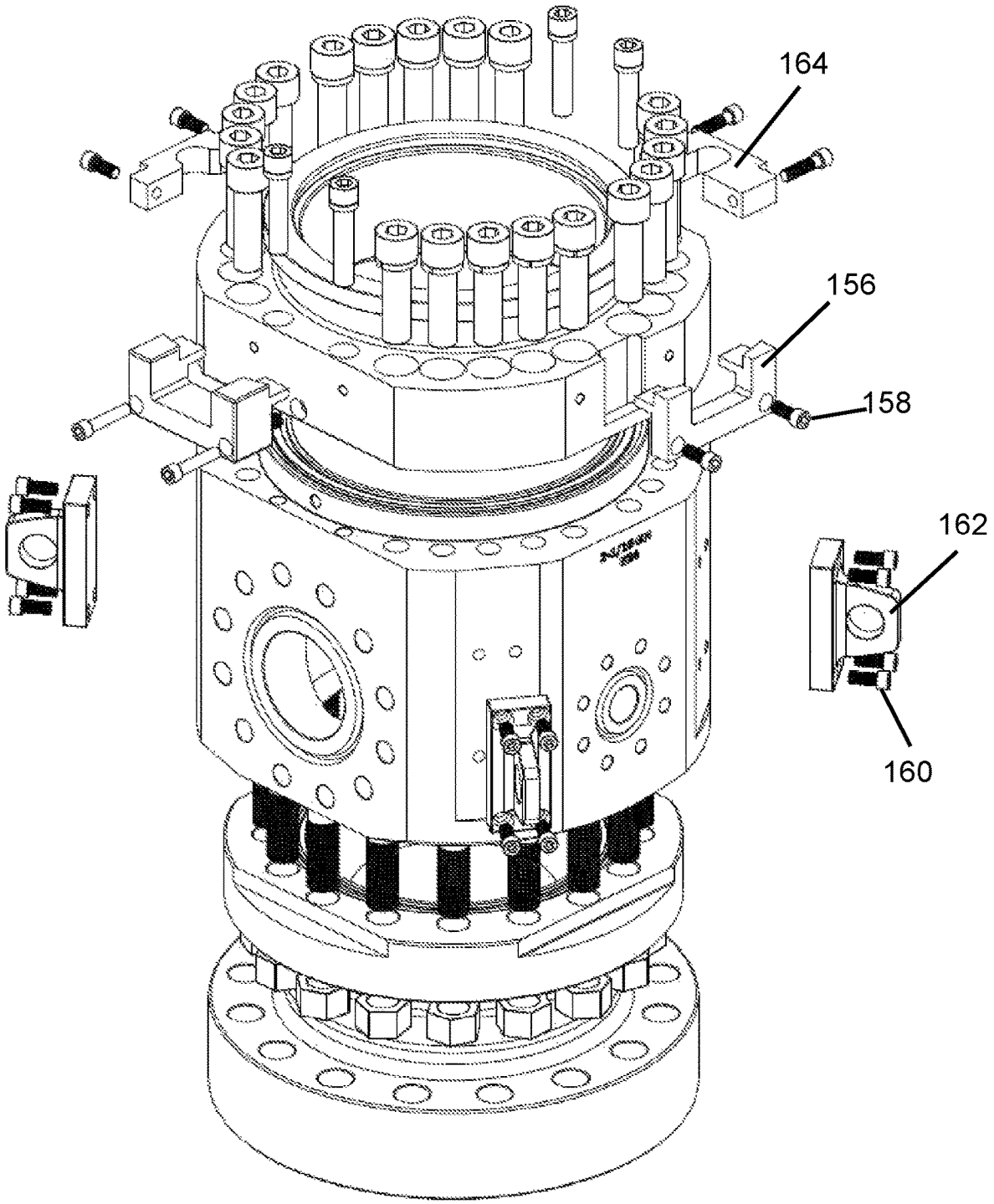
FIG. 12 is an exploded view thereof.
Figure 13:
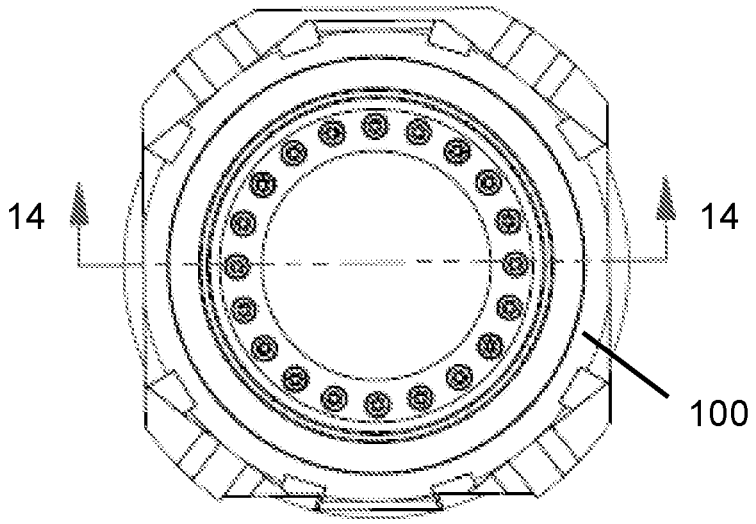
FIG. 13 is a top view of one embodiment of the present invention.
Figure 14:
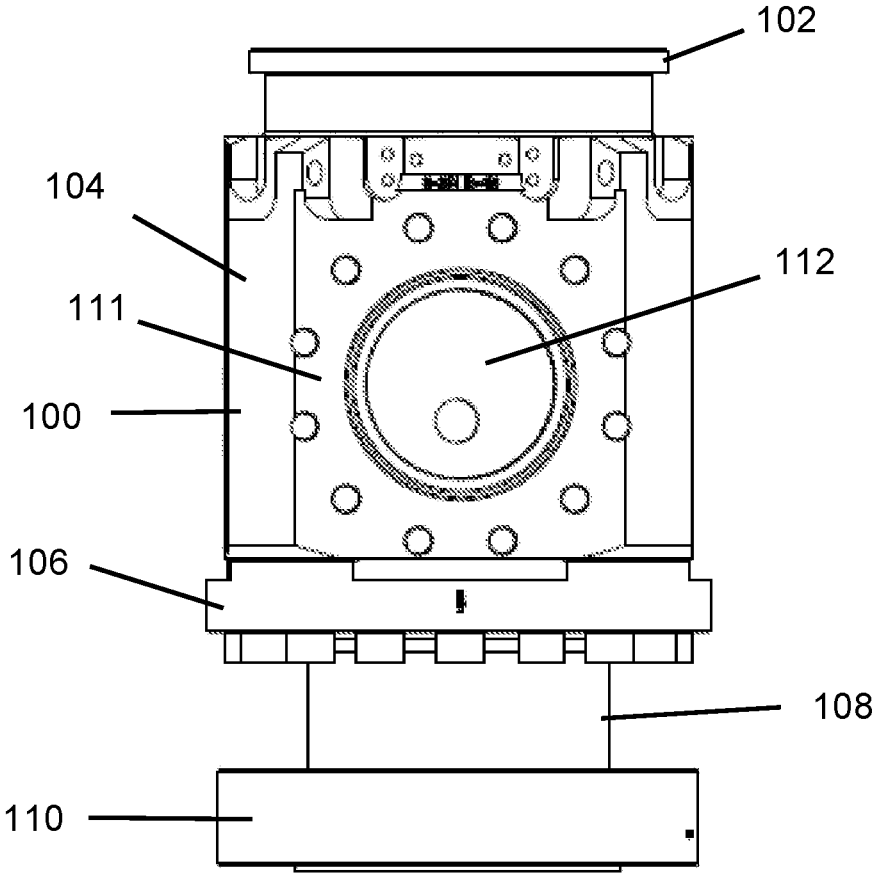
FIG. 14 is a front view thereof.

FIG. 12 shows an exploded view with the clamp outriggers 156, 164 secured by fasteners 158. The clamp outriggers have a long side 156 and a short side 164. The clamp outriggers enable attachment of the clamp with the bowl.

FIGS. 13-19 show the bowl body that secures with the swivel neck that allows rotation of the bowl body. The bowl body 104 rotates in relationship to the annular. Such pivoting of the bowl body 104 aligns the outlet of the appropriate size with the flow line. The bowl body 104 is then secured into a fixed position after the proper alignment.

The user secures the swivel neck 108, the connector 106, the bowl body 104, and the bowl top 102 in position after proper alignment with the flow line. Securing swivel neck 108 within the base 110 limits rotation of the swivel neck 108, the connector 106, the bowl body 104, and the bowl top 102. When fixed into position, the outlet 112 is fixed into position with the base 110 for securing the flowline at the outlet 112. The bowl body 104 attaches to a flow line to allow fluids and other materials to flow into and out of the modular bowl system 100. A flow aperture 112 of the bowl provides access into the interior of the housing 100 and downhole from the side of the housing 100.

The flow aperture may serve as an outlet 112. The flow aperture, as an outlet 112, enables fluids and other materials to flow from downhole into the modular bowl system 100 and through the flow line. The flow line attaches at the attachment surface 111 of the bowl body 104.

The modular system 100 allows attachment of the flow line at a flattened attachment surface 111. In one embodiment, an outlet flange attaches at the attachment surface 111. The flow line secures to the bowl body 104 at attachment surface 111.

The flow line seals against the bowl body 104 to allow fluids and other materials to flow either into or out of the housing 100. Flow lines are available in multiple sizes, such as 11-3 M, 7-5 M, and 9-3 M. The bowl body 104 provides different sized flow apertures, such as outlet 112, that enables attachment of different sized flow lines to the housing 100. Rotating the bowl body 104 to a different sized flow aperture provides an additional attachment surface capable of securing a different sized flow line to the bowl body 104 and the bowl system 100.

Figure 15:
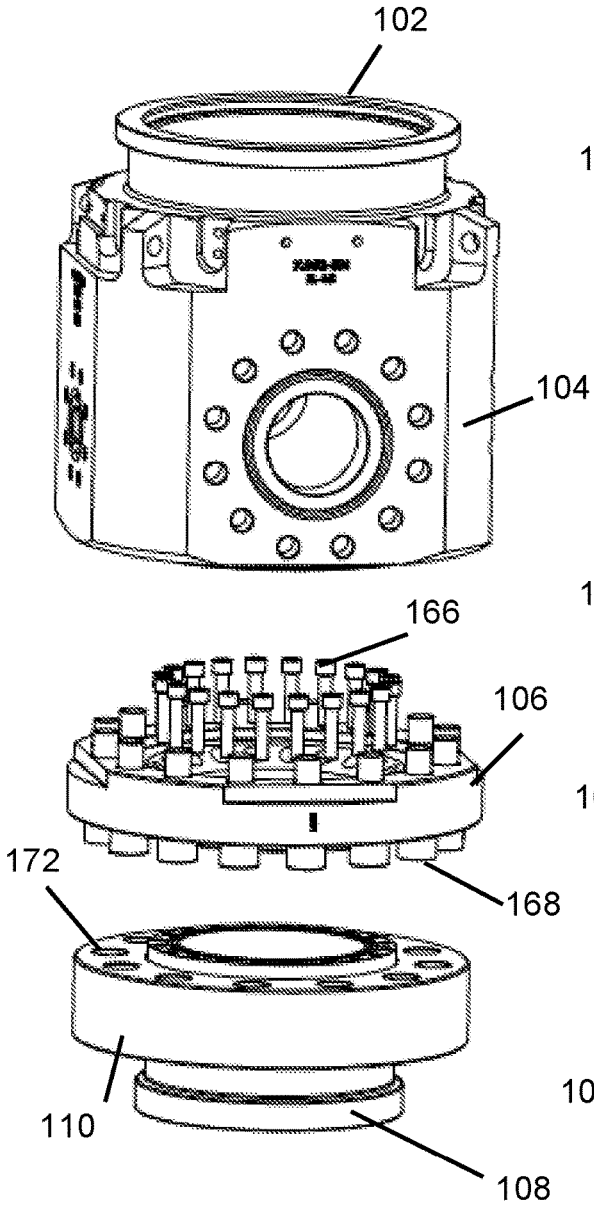
FIG. 15 is an exploded view of one embodiment of the present invention.
Figure 16:
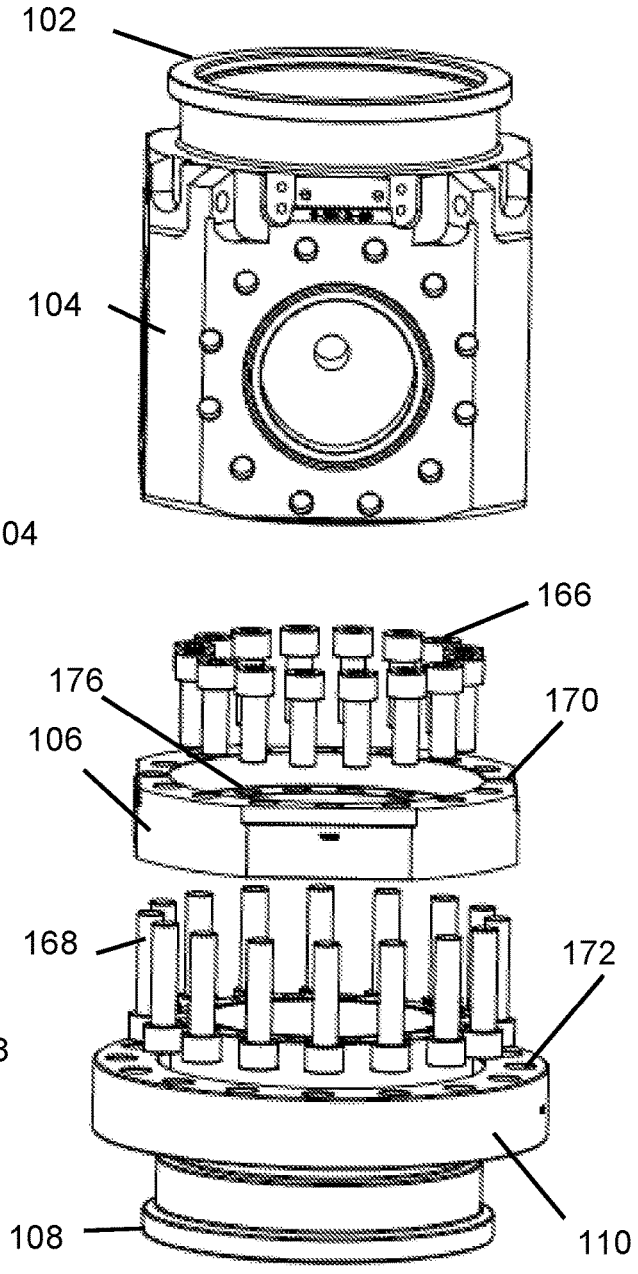
FIG. 16 is an exploded view of one embodiment of the present invention.

FIGS. 15 and 16 show exploded views of securing the bowl body 104 and bowl top 102 with the connector 106 and swivel neck 108. Fasteners 166, such as interior fasteners, install vertically downward through interior attachment apertures 176 of the connector 106 to secure the connector 106 to the swivel neck 108. The interior fasteners 166 may include but are not limited to bolts, threaded fasteners, socket head cap screws, or other fasteners. The interior attachment apertures 176 are located laterally outward from the bore through connector 106. In one embodiment, the interior attachment apertures 176 are located radially outward from the bore.

The bottom of the bowl body 104 secures to connector 106. Fasteners 168, such as exterior fastener, secure the connector 106 and the bowl body 104. The fasteners 168 may include but are not limited to threaded fasteners, screws, bolts, socket head cap screws, stud and nut, or other fasteners. The fasteners 168 insert into exterior attachment apertures 170 located laterally outward from the interior attachment apertures 176 and the bore. In one embodiment, the exterior attachment apertures 170 of the connector are located radially outward from the bore. Exterior fasteners 168 insert upward through connector 106 into the bowl body 104. Exterior fasteners 168 secure the connector 106 to the bowl body 104.

Attachment apertures 172 of the base 110 accept a fastener to secure the base 110 to the annular. In one embodiment, the attachment apertures 172 accept a fastener, including but not limited to a threaded fastener, a screw, a bolt, a stud, socket head cap screw, or other fastener. In one embodiment, a stud extends upward from the annular. The studs secured to the annular insert upward into attachment apertures 172 from the annular below the base 110.

Figure 18:
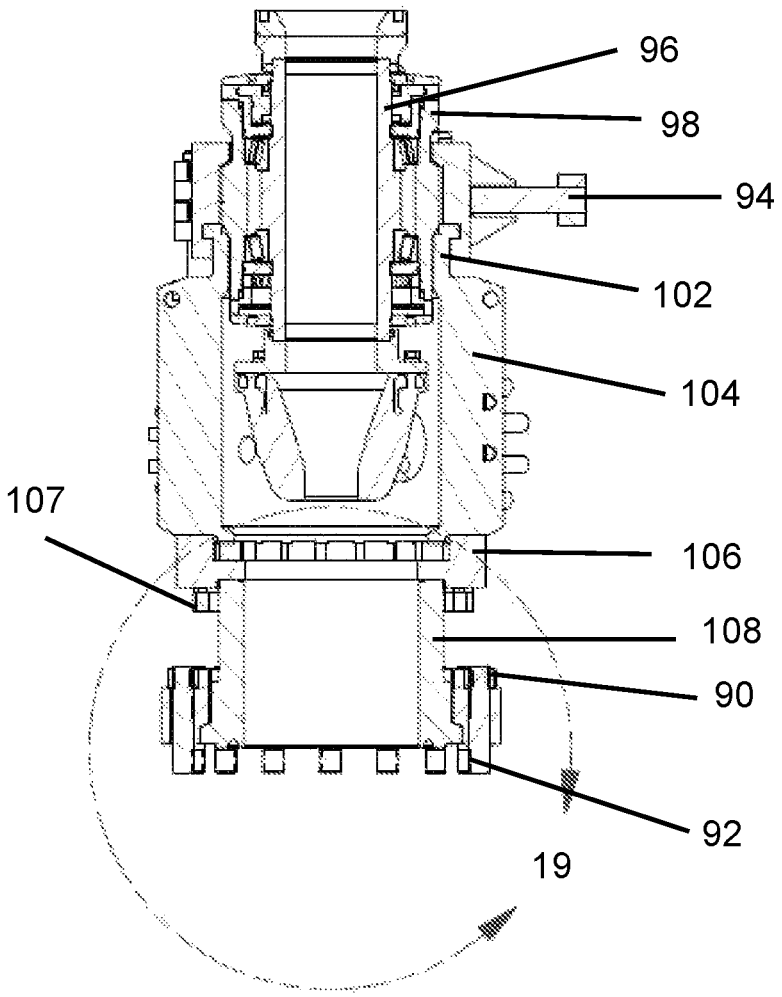
FIG. 18 is a sectional view thereof.
Figure 17:
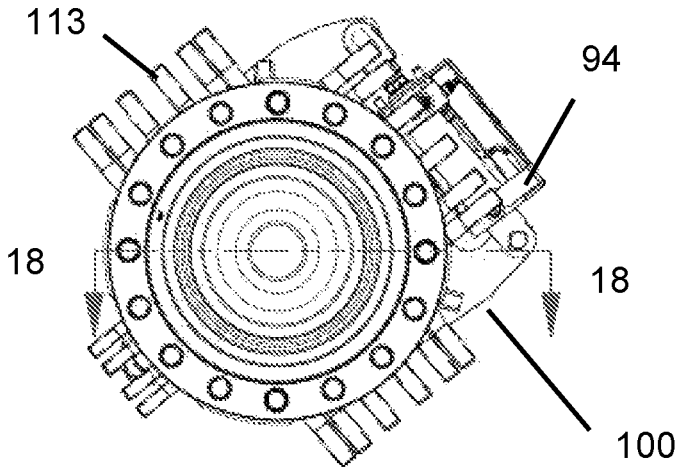
FIG. 17 is a top view of one embodiment of the present invention.
Figure 19:
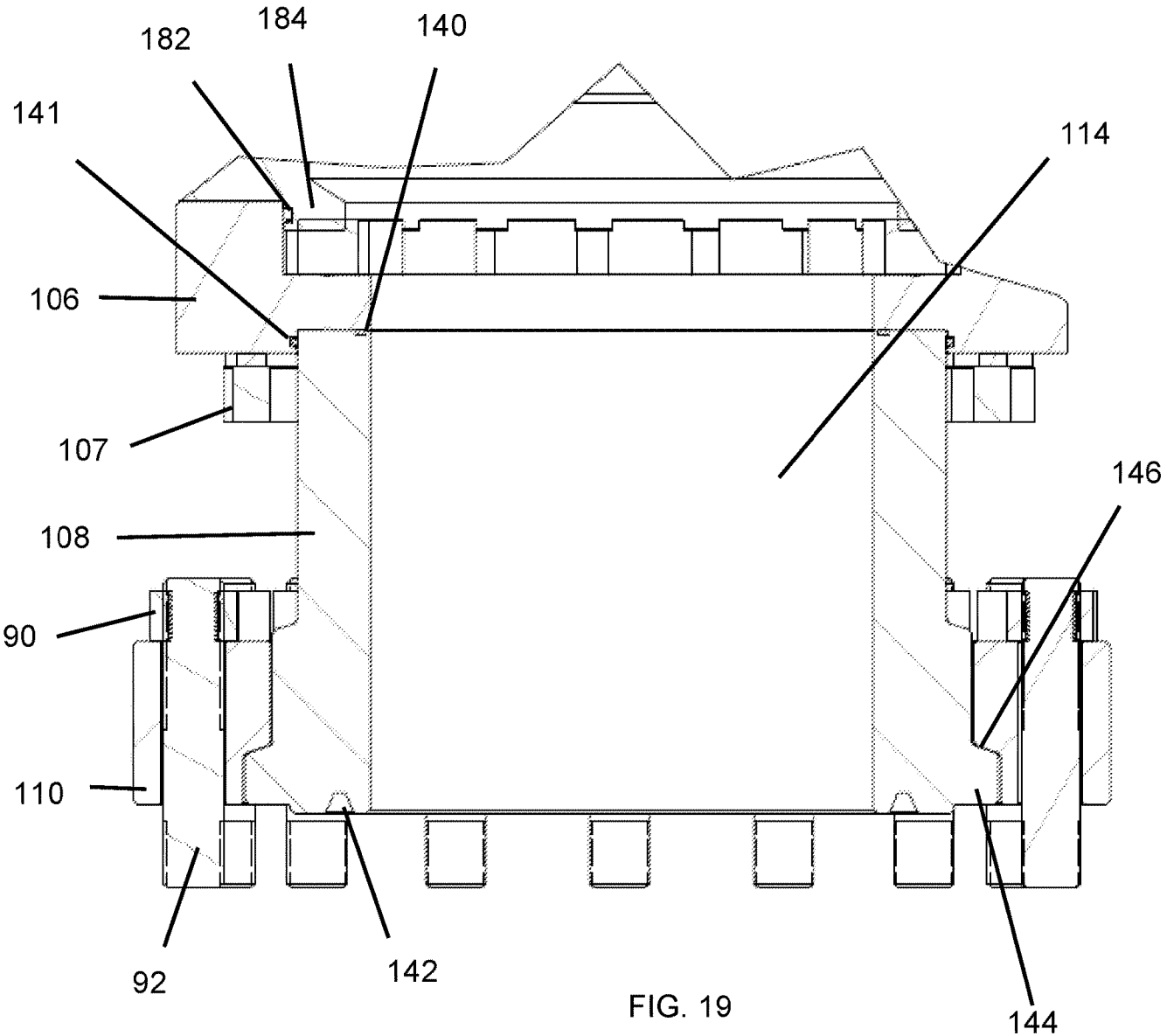
FIG. 19 is a partial sectional view thereof.

FIGS. 17-19 show the attachment of the bowl top 102 with the bowl body 104. FIGS. 17-19 also show the attachment of the bowl body 104 with the connector 108 and base 110. Clamp 94 secures the inner barrel 96 and the outer barrel 98 within the bowl system 100. The outer barrel 98 remains stationary within the bowl system while the inner barrel 96 rotates within the outer barrel 98.

Flow connection studs 113 secure the flow line to the bowl body. The user secures the flow line with nuts on the studs 113. Flow connection studs 113 are located around the flow apertures 112. For example, flow connection studs 113 are arranged around the outlets and the inlet.

FIG. 17 shows a top view of the bowl system 100. FIG. 17 shows the studs 113 extending outward around the flow apertures, three outlets and one smaller sized inlet.

FIG. 18 shows a sectional view of the inner barrel 96 and outer barrel 98 within the bowl body 104. The clamp 94 secures bowl top 102 to the outer barrel 98. The inner barrel 96 and the outer barrel 98 secure within the bowl system 100. Clamp 94 secures the outer barrel 98 within the bowl system 100. The outer barrel 98 enables rotation of the inner barrel 94 within the outer barrel. Clamp 94 secures outer barrel 98 with the bowl system 100 and limits movement of the outer barrel 98 within the bowl system 100.

FIG. 18 also shows fastener 168 securing the connector 106 to the bowl body 104. The fastener 107, such as a bolt or other threaded fastener, inserts upward through the exterior attachment aperture of the connector 106 to secure the connector 106 with the bowl body 104.

FIGS. 18 and 19 show the attachment of the base 110 with the annular. Fasteners 92 secure the base 110 to the annular. Fasteners, such as studs 92, extend upward from the annular, for insertion through the attachment apertures 172 of the base 110. Nuts 90 secure to the studs 92 to secure the base 110 to the annular. The nuts 90 also tighten the base 110 to limit movement of the swivel neck 108 within the base 110.

Nuts 90 tighten on the studs 92 to limit rotation of the bowl body 104. Locking foot 144 extends radially outward from the swivel neck 108 as the most exterior portion of the neck from the bore. Nut 90 tightens the locking contact 146 down onto the foot 144. The locking contact 146 limits rotation of the swivel neck 108 within the base 110. The base 110 is placed onto the swivel neck 108 to position the locking contact 146 onto the locking foot 144.

FIG. 19 shows the fasteners, such as stud 92, extending through the base 110. Other fasteners, such as nuts 90, secure the base 110 on the flange via the fasteners, such as studs 92. The swivel neck 108 connects to the connector 106 while the base 110 secures the swivel neck 108 to the annular for rotation of the swivel neck 108, the connector 106, and the bowl body 104. The swivel neck provides seals 140, 141, 142 to seal the connection between the swivel neck 108 and the annular and between the swivel neck 108 and the connector 106. Seal grooves 140, 141, 142 provide spacing for placement of the seals to seal between the connector 106, the swivel neck 108, and the annular.

The outermost surface of the swivel neck 108 extends laterally outward at the locking foot 144. In one embodiment, the outermost surface of the swivel neck 108 extends radially outward from the bore 114. The increased radius of the locking foot 144 limits upward movement of the swivel neck 108 within the base 110. The innermost surface of the base 110 extends laterally outward from the bottom such that the size of the opening within the base 110 is greatest at the lowest point of the base 110. The opening is greatest below the locking contact 146 for to allow the swivel neck 108 to partially pass through the base 110 except for the locking foot 144.

Locking contact 146 contacts the locking foot 144. Such contact between the locking contact 146 and the locking foot 144 limits upward vertical movement of the swivel neck 108 within the base 110.

As the nuts 90 tighten down onto the studs 92, the locking contact 146 tightens down on the locking foot 144. The locking contact 146 limits the vertical upward movement of the swivel neck 108 within the base 110. Tightening the nuts 90 onto the studs 92 increases the tension of the locking contact 146 on the foot 144. The increased tension of the locking contact 146 on the foot limits rotation of the swivel neck 108 within the base 110.

Figure 20:
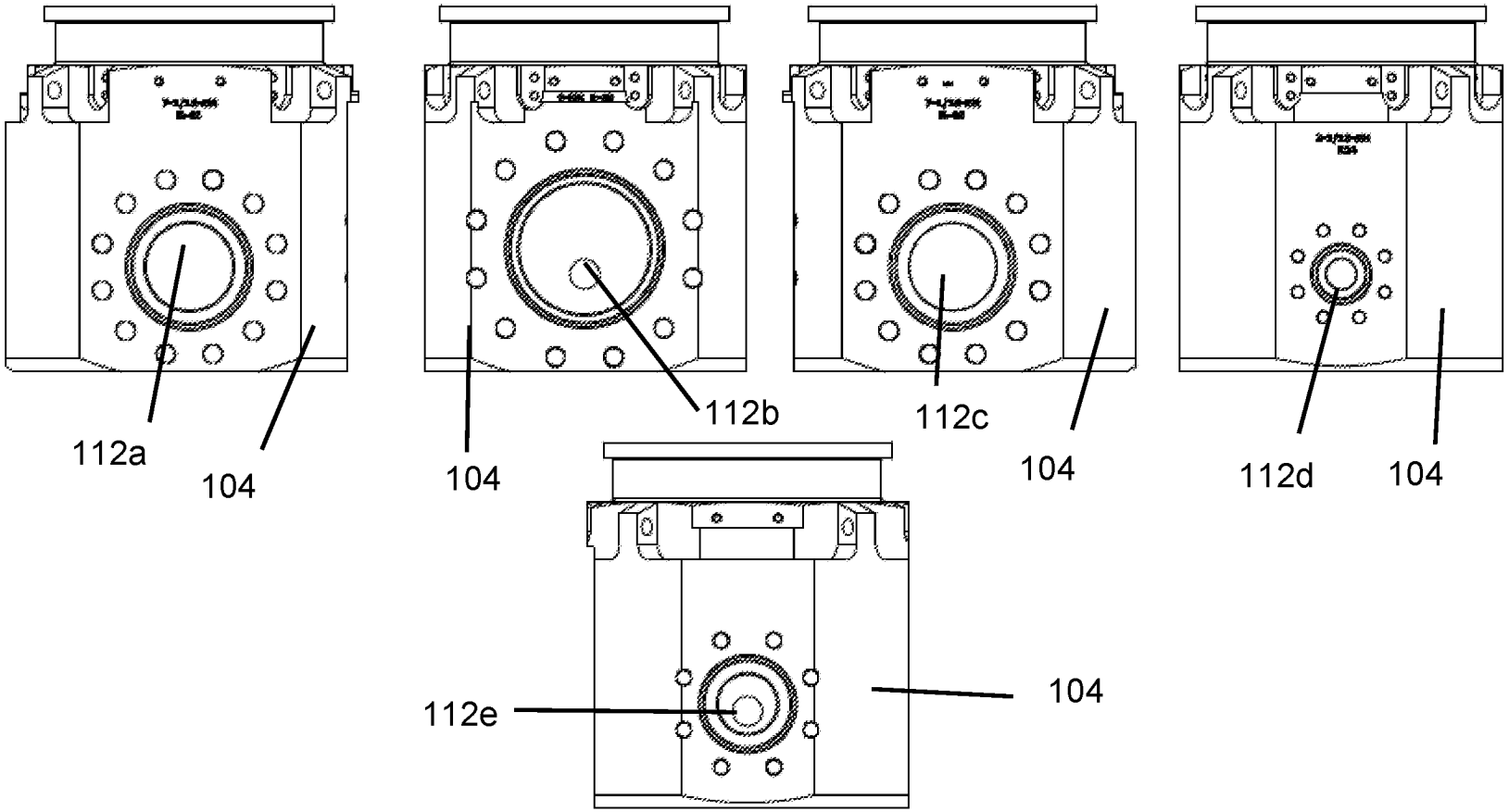
FIG. 20 is a view of different embodiments of one embodiment of the present invention.

FIG. 20 shows the different sized outlets available with bowl body 104. The bowl body 104 provides flow apertures that may vary in size. The size of the flow apertures 112 depend on the flow line and the needs at the drilling site. The outlets 112*a*, 112*b*, 112*c*, 112*d*, 112*e* vary in size according to the needs of the well. The sizes of the flow apertures include but are not limited to 7-5 M shown in flow aperture 112*a*, 9-3 M shown in flow aperture 112*b*, 9-5 M shown in flow aperture 112*c*, 2-1/16-3/5 M inlet shown in flow aperture 112*d*, and a 4-1/16-3 M/5 M inlet shown in flow aperture 112*e*. The user may rotate the bowl body 104 to align the appropriate flow aperture 112*a*, 112*b*, 112*c*, 112*d*, 112*e* for use in the drilling system.

Figure 22:
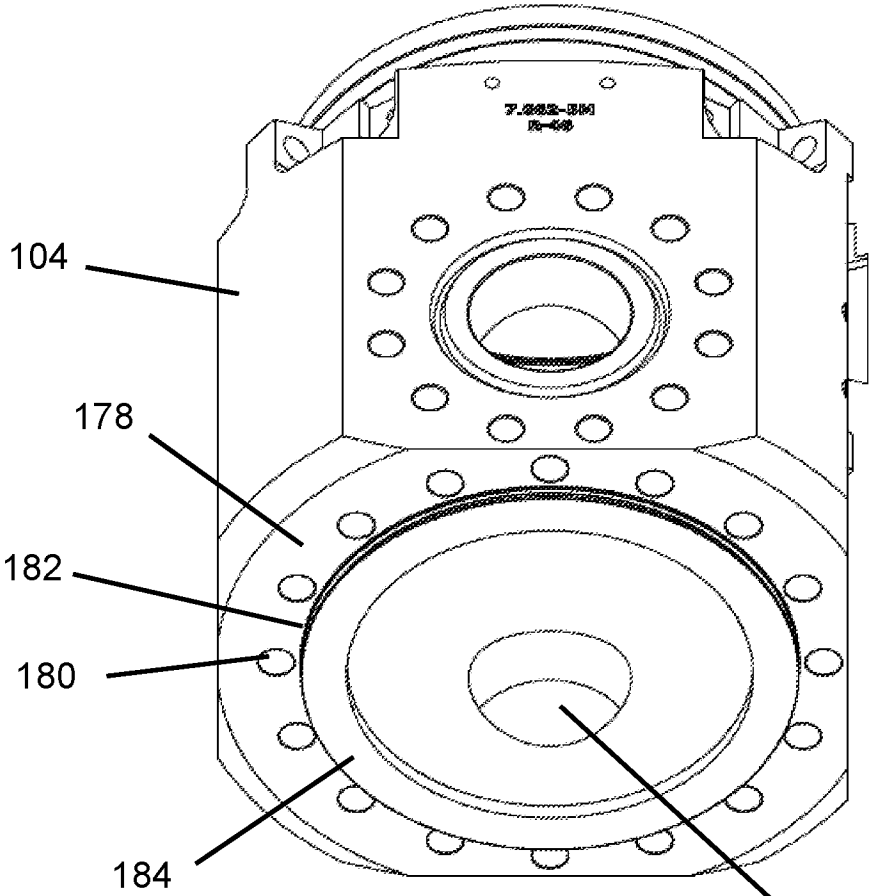
FIG. 22 is a perspective view thereof.
Figure 21:
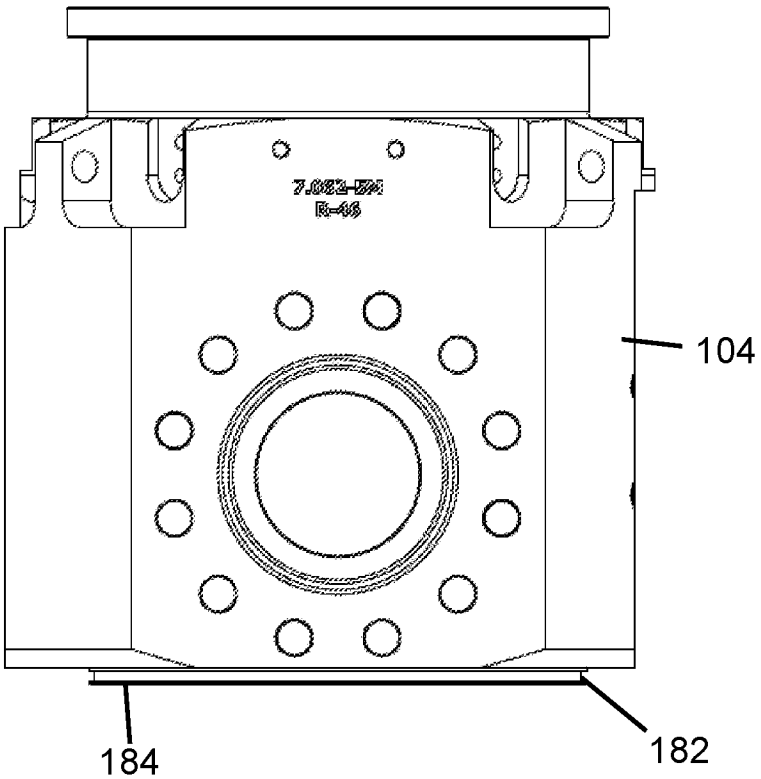
FIG. 21 is a front view of a bowl body of one embodiment of the present invention.

FIGS. 21-22 show the base body 104 for the rotatable body. The bowl body 104 provides attachment apertures 180 located laterally outward from the bore 114 and the lip 184. The lip 184 extends downward from the lower flange 178 of the bowl body 104. The lip 184 extends into the connector 106. The lip 184 provides a seal groove 182 in which a seal is placed for sealing against the interior side wall of the connector as shown in FIG. 19.

From the foregoing, it will be seen that the present invention is one well adapted to obtain all the ends and objects herein set forth, together with other advantages which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A modular bowl system for securing a bowl to an annular, the system comprising:

a bowl body having at least a first flow aperture and a second flow aperture;

a central bore extending through the bowl body wherein the central bore defines a vertical axis, the first flow aperture of the bowl body allowing passage through the bowl body into the central bore;

the second flow aperture of the bowl body allowing passage from the central bore through the bowl body;

a bottom flange of the bowl body;

an attachment aperture of the bowl body extending vertically upward into the bottom flange;

a modular bottom that secures to the bowl body wherein the central bore extends through the modular bottom;

a top flange of the modular bottom;

an attachment aperture of the modular bottom extending vertically downward into the top flange of the modular bottom, wherein the attachment aperture of the modular bottom accepts a fastener that passes into the attachment aperture of the bowl body to secure the modular bottom to the bowl body;

a facing of the bowl body located adjacent the first flow aperture wherein the facing provides a flat surface at a lateral outer edge of the bowl body from the central bore; and a clearance aperture that reduces the height of the modular bottom at a lateral outer edge from the central bore of the modular bottom wherein the clearance aperture aligns with the facing of the bowl body wherein the clearance aperture abuts the facing.

2. A modular bowl system for securing a bowl to an annular, the system comprising:

a bowl body having at least a first flow aperture and a second flow aperture;

a central bore extending through the bowl body wherein the central bore defines a vertical axis, the first flow aperture of the bowl body allowing passage through the bowl body into the central bore;

the second flow aperture of the bowl body allowing passage from the central bore through the bowl body;

a bottom flange of the bowl body;

an attachment aperture of the bowl body extending vertically upward into the bottom flange;

a modular bottom that secures to the bowl body wherein the central bore extends through the modular bottom;

a top flange of the modular bottom;

an attachment aperture of the modular bottom extending vertically downward into the top flange of the modular bottom, wherein the attachment aperture of the modular bottom accepts a fastener that passes into the attachment aperture of the bowl body to secure the modular bottom to the bowl body;

wherein the modular bottom enables rotation of the bowl body, first flow aperture, and the second flow aperture while securing the bowl body to the annular;

a swivel neck secured to the bowl body; and a base that attaches to the annular wherein the swivel neck extends downward into the base, wherein the swivel neck rotates in relation to the base.

3. The system of claim 2 wherein tightening the base onto the annular increases contact of the base on the swivel neck to limit rotation of the swivel neck within the base.

4. The system of claim 3 further comprising:

a locking contact of the base wherein the central aperture of the base widens below the locking contact;

a locking foot of the swivel neck that extends radially outward beyond the outer surface of the swivel neck located above the locking foot wherein the locking foot is sized not to pass vertically above the locking contact, wherein a fastener secures the base to the annular wherein tightening the fastener increases the pressure of the locking contact on the locking foot to limit rotation of the swivel neck within the base.

5. A modular bowl system for securing a bowl to an annular, the system comprising:

a bowl body having at least a first flow aperture and a second flow aperture;

a lower flange of the bowl body;

a central bore extending through the bowl body wherein the central bore defines a vertical axis, the first flow aperture of the bowl body allowing passage through the bowl body into the central bore;

the second flow aperture of the bowl body allowing passage from the central bore through the bowl body;

a modular bottom having an upper flange that secures to the lower flange of the bowl body wherein the central bore extends through the modular bottom;

an upper seal secured on a top surface of the upper flange of the modular bottom wherein the seal seals between the upper flange of modular bottom and the lower flange of the bowl body by contacting the modular bottom and the lower flange of the bowl body;

a connector that secures the bowl body;

a swivel neck that secures to the connector wherein the connector secures the swivel neck to the bowl body;

a base that attaches to the annular wherein the swivel neck extends downward into the base, wherein the swivel neck, connector and bowl body rotate in relation to the base.

6. The system of claim 5 further comprising:

a locking contact of the base wherein the central aperture of the base widens below the locking contact;

a locking foot of the swivel neck that extends radially outward beyond the outer surface located above the locking foot wherein the locking foot is sized not to pass vertically above the locking contact, wherein the locking foot is the outermost radial surface of the swivel neck;

wherein a fastener secures the base to the annular wherein tightening the fastener increases the pressure of the locking contact on the locking foot to limit rotation of the swivel neck within the base.

7. A modular bowl system for securing a bowl to an annular, the system comprising:

a bowl body having at least a first flow aperture and a second flow aperture;

a central bore extending through the bowl body wherein the central bore defines a vertical axis, the first flow aperture of the bowl body allowing passage through the bowl body into the central bore;

the second flow aperture of the bowl body allowing passage from the central bore through the bowl body;

a bottom flange of the bowl body;

a modular bottom that secures to the bowl body wherein the central bore extends through the modular bottom;

a top flange of the modular bottom having a top diameter, wherein the top flange has a flattened surface;

a bottom flange of the modular bottom having a bottom diameter, wherein the bottom flange has a flattened surface, wherein the top diameter of the top flange of the modular bottom is sized different than the bottom diameter of the bottom flange;

wherein the central bore through the modular bottom has a diameter that varies in size, wherein the diameter of the central bore at the top flange of the modular bottom is sized different than the diameter of the central bore at the bottom flange of the modular bottom.

* * * * *